US007055246B2

(12) United States Patent
Satoh et al.

(10) Patent No.: US 7,055,246 B2
(45) Date of Patent: Jun. 6, 2006

(54) SHAVER

(76) Inventors: Teizoh Satoh, 4-12-11, Okayamahigashi, Shijonawate-shi, Osaka (JP); Nobuhiko Sato, 4-12-11, Okayamahigashi, Shijonawata-shi, Osaka (JP)

( * ) Notice: Subject to any disclaimer, the term of this patent is extended or adjusted under 35 U.S.C. 154(b) by 5 days.

(21) Appl. No.: 10/832,697

(22) Filed: Apr. 27, 2004

(65) Prior Publication Data

US 2004/0250430 A1 Dec. 16, 2004

Related U.S. Application Data

(63) Continuation of application No. 09/888,190, filed on Jun. 22, 2001, now Pat. No. 6,769,179.

(30) Foreign Application Priority Data

| | | |
|---|---|---|
| Jul. 6, 2000 | (JP) | 2000-205371 |
| Oct. 3, 2000 | (JP) | 2000-303678 |
| Mar. 9, 2001 | (JP) | 2001-066230 |

(51) Int. Cl.
*B26B 19/14* (2006.01)

(52) U.S. Cl. ..... 30/43.6; 30/346.51

(58) Field of Classification Search ..... 30/43.4–43.6, 30/43.92, 34.2, 346.51, 43.47, 43.9
See application file for complete search history.

(56) References Cited

U.S. PATENT DOCUMENTS 4,635,360 A * 1/1987 Tanahashi et al. ..... 30/34.2

* cited by examiner

*Primary Examiner*—Timothy V. Eley

(57) ABSTRACT

The present invention relates to the shaver capable of cutting deeply, provided with the outer blade having a plurality of the hair-guiding ports and the inner blade being adjacently located to the inner part of the outer blade and relatively moving against the said inner part, serving like an electric shaver of rotation or motion, which consists in going back and forth adjacently, wherein there is provided an escaping gap for taking hairs out in one part between the outer and inner blades, thus hooking the hairs guided into the gap, on the tip of the inner blade or pinching them inside the escaping gap and afterward, taking out the hairs and beards from the root of hairs and when the hairs move to the region without any escaping gap, they will be cut in the deep location.

7 Claims, 30 Drawing Sheets

(a)

(b)

(a)

(b)

SHAVER

This is a continuation of application Ser. No. 09/888,190 filed Jun. 22, 2001, now U.S. Pat. No. 6,769,179.

BACKGROUND OF THE INVENTION

1. Field of the Invention

The present invention relates to a shaver such as an electric shaver, with blades rotating or moving back and forth and adjacently to each other, provided with the outer blades having a plurality of ports for guiding hairs and beards inside, together with the inner blades moving in relative movements against the said inner part.

2. Description of the Prior Art

Generally, the shaver in the above-mentioned example has many ports for guiding hairs inside on the outer blades for touching the skin on its outer surface, which shaver is used to cut the hairs guided inside the guiding ports by means of the cutting blade provided on the edge of the inner side of the hair-guiding ports and the cutting blade provided on the tip of the inner blade, which is adjacent to the inner part of the outer blade.

In this way, according to the shavers, there is a problem that hairs and bears cannot be shaven with a sufficient deepness inside because the hairs and beards guided into the guiding holes are to be cut on the tip of the inner blades adjacent to each other in the inner side of the outer blades, making the cutting points away from the skin for the thickness of the outer blade.

In order to resolve these problems, as a conventional methods that have been adopted, the cutting points of the hairs and bears were brought close to the skin by making the outer blades thinner and the lift-blades for taking out the hairs and beards from the root of hairs were provided on the front side of the inner blades.

The thickness of the outer blade of the current deep-cutting shaver may be between about 75 μm and 80 μm because the thinning of the outer blade is limited in order to secure the rigidity of the same outer blade and not to hurt skin got into the guiding port. Therefore, with this method only, it is hard to carry out the deep cutting like hand-cutting knife.

On the other hand, the means for providing a lift-blade is constructed as shown in the FIG. 30 as an exemplified plan.

In other words, as shown in the above figure with a sign (*a*), the lift blade 51 is pushed resiliently toward the inner side of the outer blade 53 in the front side of the inner blade 52, go that the lift blade 51 will be strongly pushed toward the hairs 55 guided into the guiding hole 54, with the tip of the blade getting stuck into the hairs 55. Thus as in the FIG. 30(*b*), the lift blade 51 will lift from the inner side of the outer blade 53 along the inclined surface of the front of the inner blade 52, taking out the hairs 55 stuck into its tip from the root of hair. Therefore, the hairs 55 guided inside will be cut with the inner blade 52 as it is taken out by the lift-blade 51.

However, the amount of lifting of the lift-blade 51 may be about 30 μm, constituting about one third of the thickness of the outer blade 53, wherein the deep cutting as with the knife to cut with the hand is impossible and also, there is a problem that the manufacturing cost becomes high as the construction will be complicated in order to make the lift blade 51 resilient in the front side of each inner blade 52.

Furthermore, there is a problem that after downy hairs or soft hairs get into the inner part of the outer blade 53 from the guiding hole 54 of the outer blade 53, they get in contact with the lift blade 51 or the inner blade 52 (especially in the case of a shaver not having the lift blade 51) and the hairs and beards leave these blades 51 and 52 while it is impossible to easily cut them regardless of the lift blade 51.

SUMMARY OF THE INVENTION

The main purpose of the present invention is to provide a shaver capable of cutting deep, wherein there is provided an outer blade having the guiding hole of a plurality of hairs on the outer sides and the inner blade adjacent to the inner side of the outer blade and moving relatively against the inner part of the outer blade, thus comprising an escaping gap for taking the hairs out on one part between the outer and inner blades and in this case the hairs guided into the said gap are hooked in the tip of the inner blade and pinched in the escaping gap and when the hairs are taken out from the root of hair and have moved to a region without an escaping gap, they are to be cut in the deep part.

Another purpose of the present invention is to provide a shaver capable of cutting deep, wherein there is provided an assisting material for taking out the hairs by moving together with the said inner blade in the vicinity of the inner blade and the hairs guided into the position of the said assisting material upon being guided into the guiding port are to be pinched between the end surface of the said material and the outer blade and taken out from the root of hair, thus being cut in the deep part after being taken out by the next inner blade.

Another purpose of the present invention is to provide a shaver capable of cutting deeply, wherein the hairs guided into a position of the assisting material are to be pinched between the assisting material and the outer blade more favorably by the resilient power by putting the assisting material to the inner side of the outer blade for resilience, thus taking the hairs out of the root of hair and cutting the hair taken out, with the next inner blade in the deeper position.

Another purpose of the present invention is to provide capable of cutting deeply in the same manner as described above, wherein the inner blades are divided into several ones and between a plurality of the inner blades and one outer blade there is formed a escaping gap for taking the hairs out.

Another purpose of the present invention is to provide a shaver capable of cutting the hairs deeply, wherein the escaping gap is formed in such a way that its distance decreases as it goes closer to the region where there is no escaping gap as described above and thus, the hairs guided into a region where the escaping gap is formed, are to be pinched more strongly as they are pinched near the region where there is no escaping gap, with the increasing power of taking out the hairs from its root.

Another purpose of the present invention is to provide a shaver capable of cutting deeply, wherein between the escaping gaps there is provided an introducing material for introducing the hairs, taking the hairs inside the outer blade sufficiently with the friction resistance or attaching power of the introducing material even though they are downy or soft hairs and the hairs are to be introduced between the outer and inner blades in order to be easily cut.

Another purpose of the present invention is to provide a shaver capable of cutting deeply, wherein there is provided an introducing material for introducing the hairs into at least one part somewhere between the assisting material and the outer blade, thus cutting easily the hairs even when they are soft as described above.

Another purpose of the present invention is to provide a shaver capable of doing the deeper cutting, wherein there is provided an assisting material in the side preceding the inner blade, thus taking the hairs with the assisting material preceding the inner blade and cutting the hairs thus taken with the following inner blade.

Furthermore, another purpose of the present invention is to provide a shaver capable of cutting the hairs introduced into the inner part of the outer blade after taking them so that they should not escape from the guiding port by means of the introducing material with the closing structure, wherein the introducing material is provided in order to close the gaps between the outer blade and the inner blade.

Other purpose of the present inventions will be easily clarified according to the examples set forth below.

BRIEF DESCRIPTION OF THE DRAWING

FIG. 15: *a* is a section view of more other examples of the shaver and *b* is a section view from the side of a.

DESCRIPTION OF THE PREFERRED EMBODIMENT

One preferred embodiment of the present invention will be clarified below according to the drawings.

The figures show the shaver, however one preferred embodiment adapted for the shaver with rotating cutters will be explained according to the present invention using the FIGS. 1 to 8.

Figure 1:
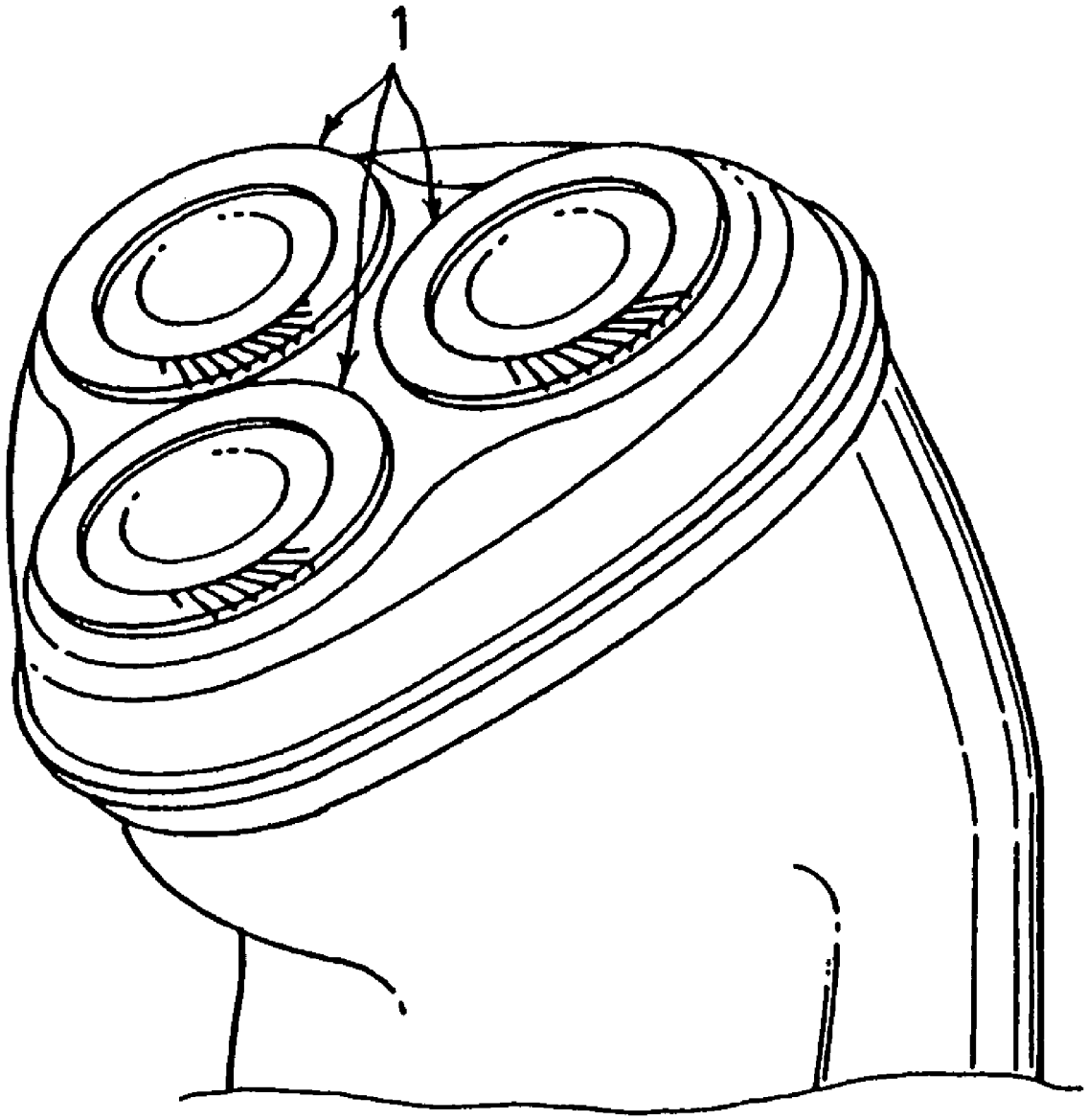
FIG. 1: an exterior perspective view of the main part of the shaver according to the present invention.

As shown in the FIG. 1, there is formed the outer blade 1 (fixed blade) in the shape of a disc for being contact with the skin, wherein the total of three outer blades 1 are provided on the tip.

Figure 2:
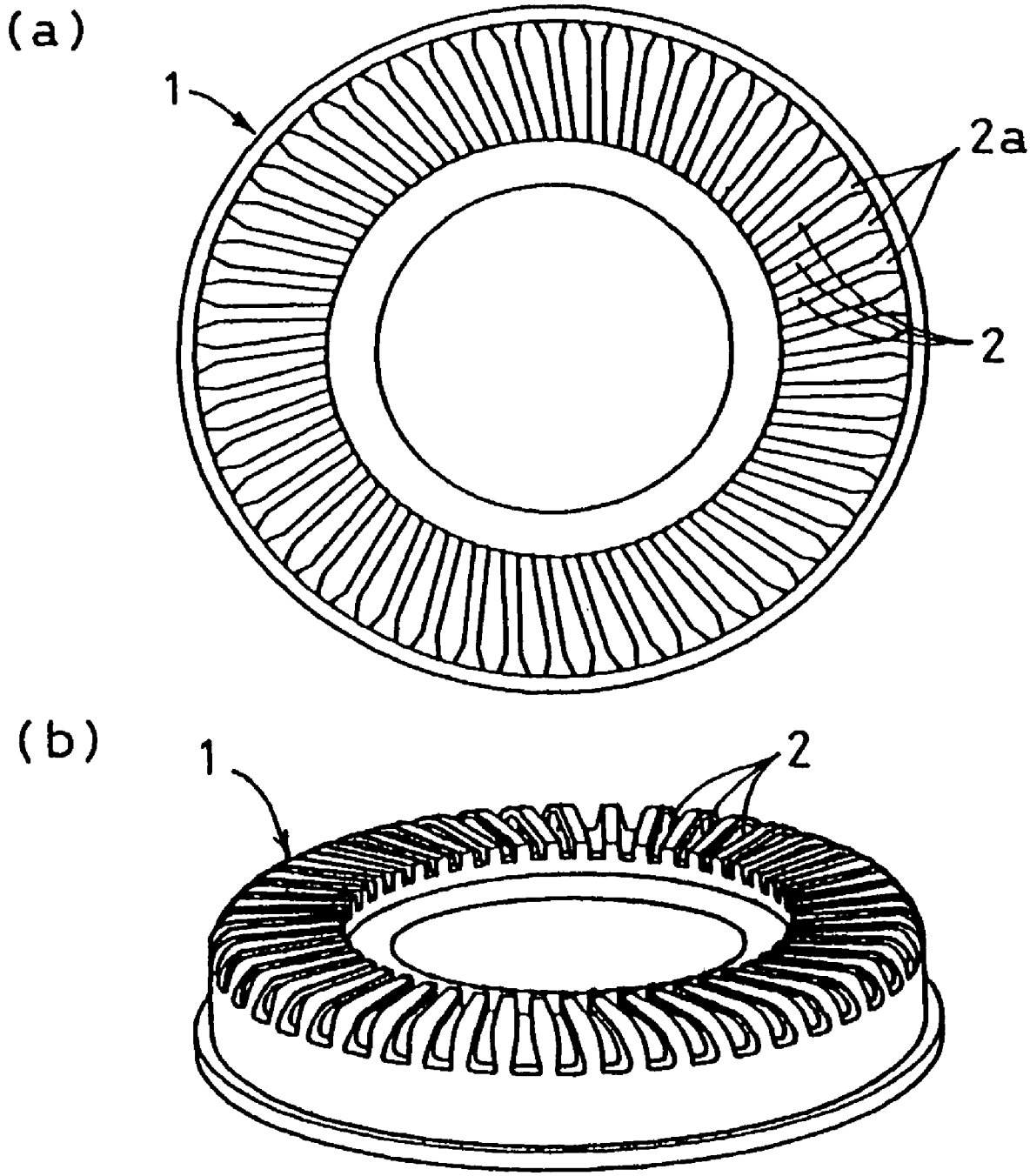
FIG. 2: *a* is a plan view of the outer blade of the shaver as in the FIG. 1 and *b* is its exterior perspective view.

Each outer blade 1 is provided with a ring shape part protruding on the outer side as shown in the FIG. 2(*a*), (*b*), wherein the guiding ports 2 for guiding hairs inside (which will be abbreviated as ports) will be radially installed in the shape of a slit on the ring shape part.

The thickness of each outer blade 1 is about 100 μm. Each port 2 is formed on the extension of the adjacent part of the inner cutter 3 (see the FIG. 3) toward both inner and outer sides, wherein on the parts extended toward the outer side, there is formed a part 2*a* whose port width is larger than other parts.

Figure 3:
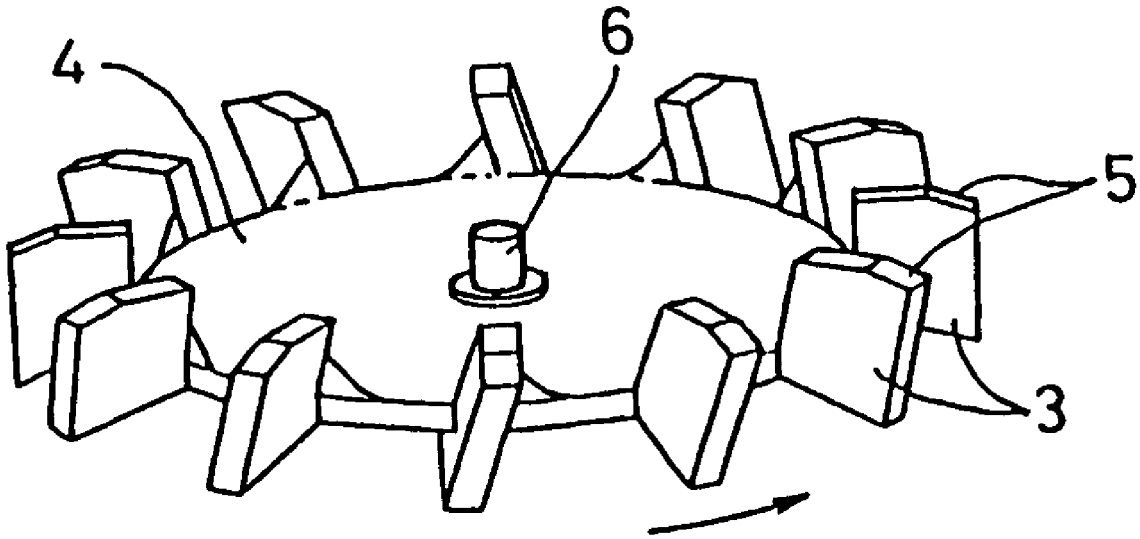
FIG. 3: an exterior perspective view of the inner blade of the shaver.

The FIG. 3 shows the inner blade 3 put adjacent to the inner part of the outer blade 1. The inner blade 3 is radially installed, inclined to the rotating direction of the disk 4 whose end side provided with the cutting blades is shown with the arrow signs on the outer part of the disk 4, driven and rotated by the motor in a given direction and on the outer side of the end part, there is provided an escaping surface 5 inclined downward to the outer side in the straight direction. In addition, in the center of the disk 4 there is provided a protrusion 6 for retaining the outer blade 1.

Figure 4:
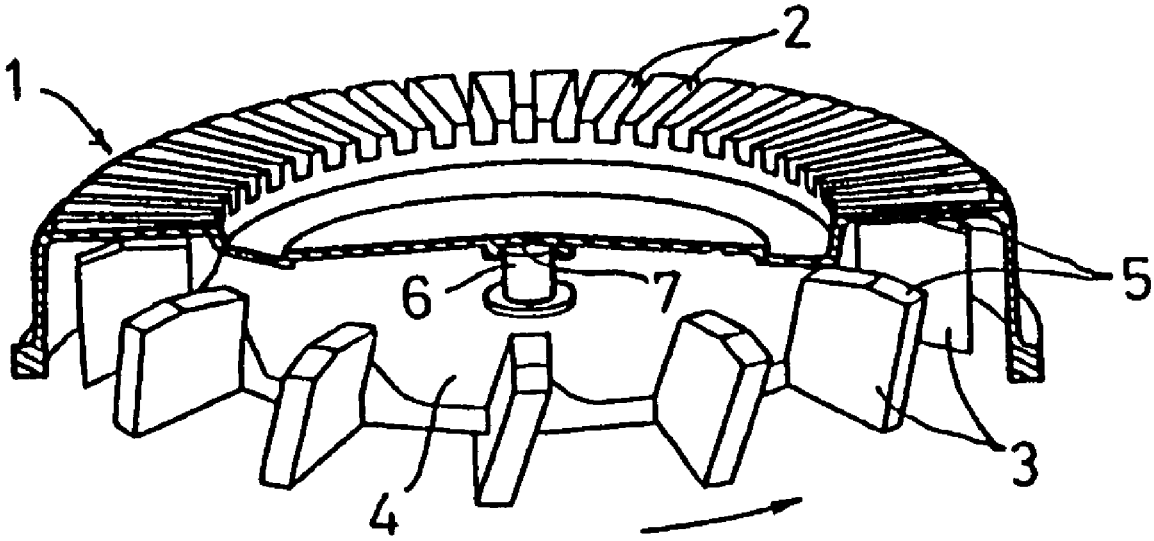
FIG. 4: a perspective cut out view showing the state of the outer blade of the FIG. 2 and the inner blade of the FIG. 3 being composed.

As shown in the FIG. 4, the outer blade 1 and the inner blade 3 are composed in such a manner that the cutting blade provided on the tip of the inner blade 3 becomes adjacent to the inner part of the ring part of the outer blade 1 installed in the port 2, as the disk 4 is rotated in the direction of the arrow. Therefore, the adjacent part of the inner blade 3 right crossing the rotating direction of the disk 4 goes in the direction of the radius of the disk 4, wherein the hairs guided into the port 2 are to be cut by means of the cutting blade of the inner blade 3 and the cutting blade provided on the inner edge of each port 2. The protrusion 6 is encased inside the port 7 provided in the center inside of the outer blade 1 in such a free way as to be rotated and these are so constructed that the disk 4 or inner blade 3 do not move around the axis.

Figure 5:
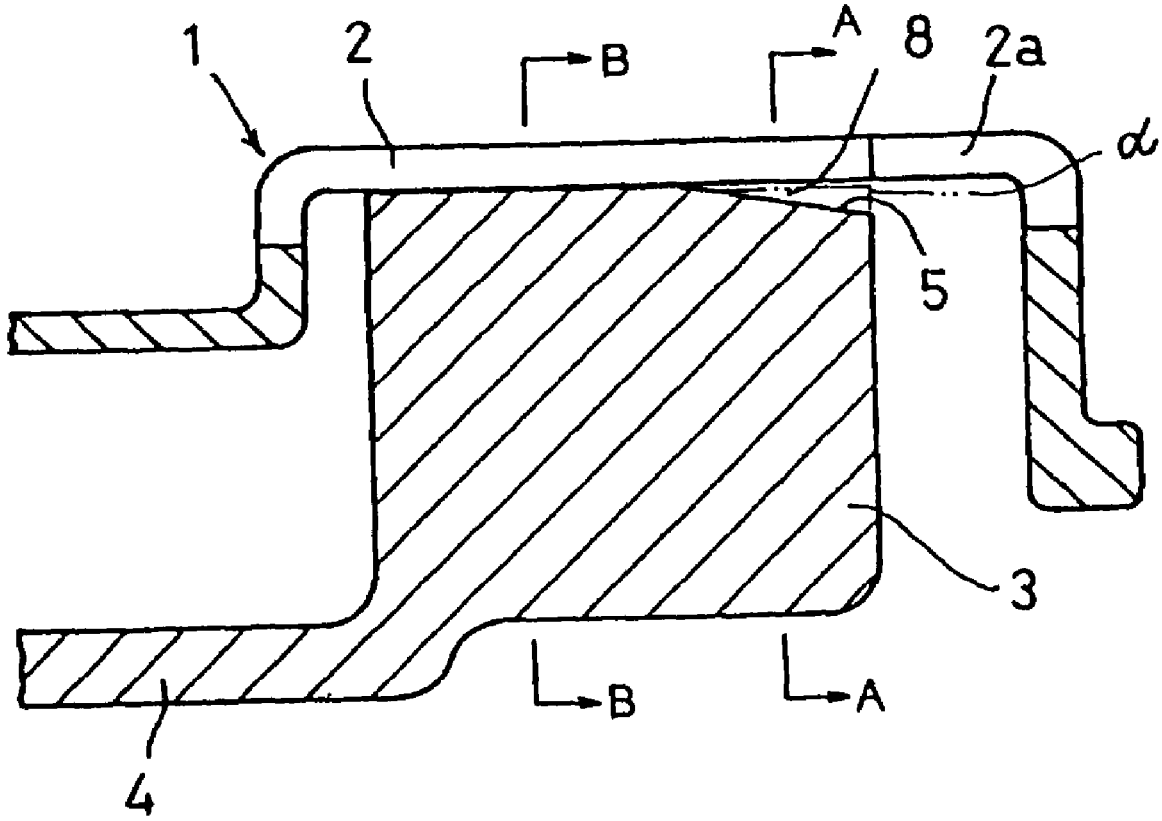
FIG. 5: a magnified section view along the direction of the radius as in the FIG. 4.

As shown in the FIG. 5, in the outer side of the inner blade 3 there is formed the escaping gap 8 getting large as it goes closer to the outer side, which escaping gap is between the outer blade 1 and the inner blade 3 with the escaping surface 5 and the utmost size of the escaping gap 8 is less than about 3 mm. Furthermore, the port 2 is extended toward both inner and outer sides from the adjacent part of the inner blade 3, wherein in the extended part of the outer side there is provided the part 2*a* with a large width. The escaping gap 8 is made less than about 3 mm because, it is more than about 3 mm, hairs might be away from the tip of the inner blade 3 without being hooked thereupon.

Figure 6:
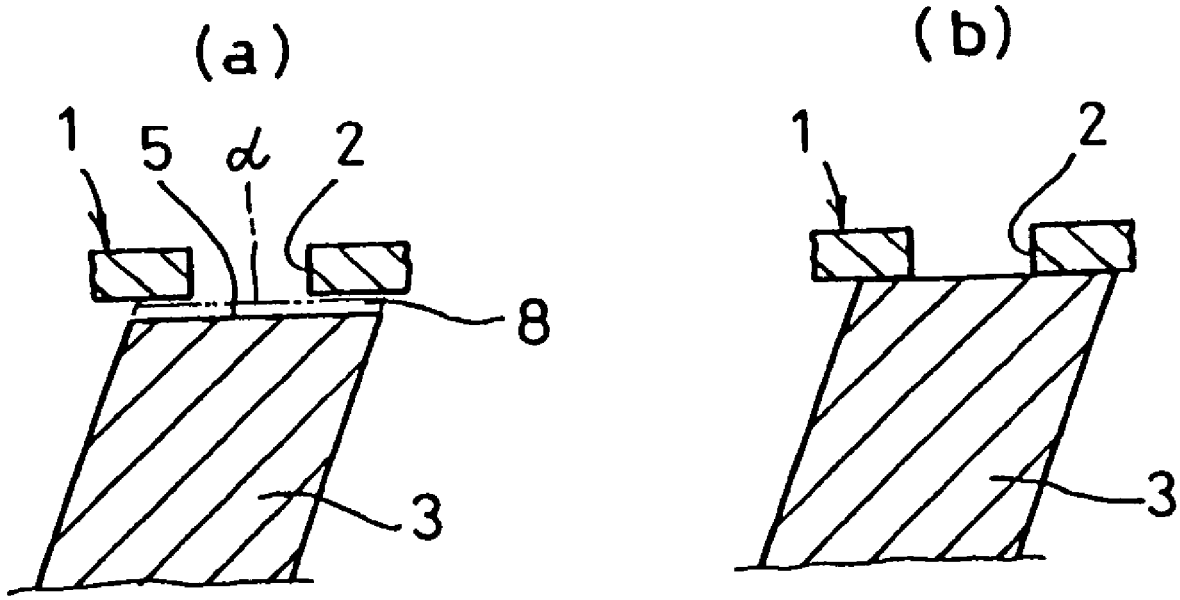
FIG. 6: *a* is an arrow section view indicating A—A line of the FIG. 5 and *b* is an arrow section view indicating B—B line of the FIG. 5.

Therefore, in the inner side of the adjacent part of the inner blade 3, the cutting clearance is large between the outer blade 1 and the inner blade 3, as shown in the FIG. 6 with (a) so that hairs guided into the port 2 will not be cut, but hairs will be only cut in the inner side of the adjacent part without an escaping gap 8 as shown in the FIG. 6(*b*).

Figure 7:
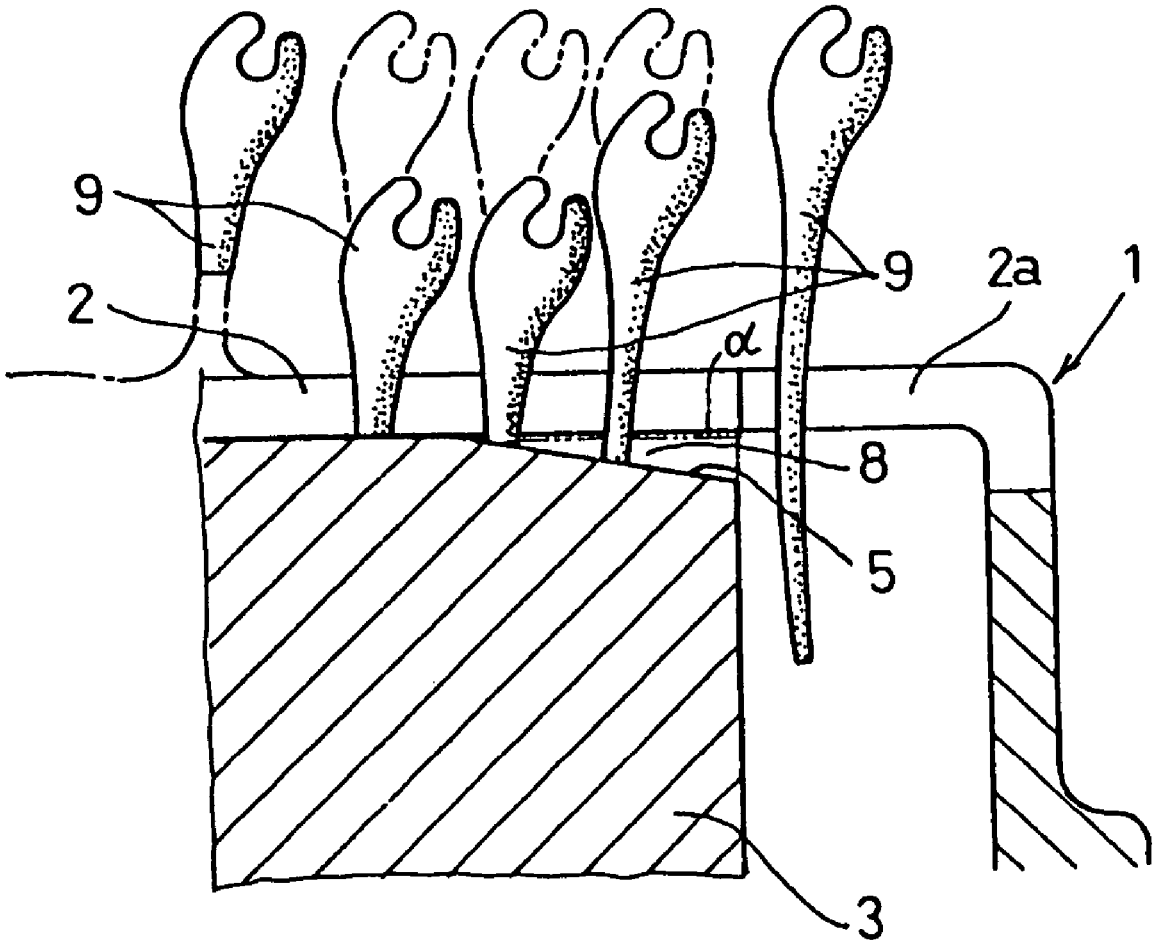
FIG. 7: Section view along the same direction is the FIG. 5 showing the cutting process of the hairs.
Figure 8:
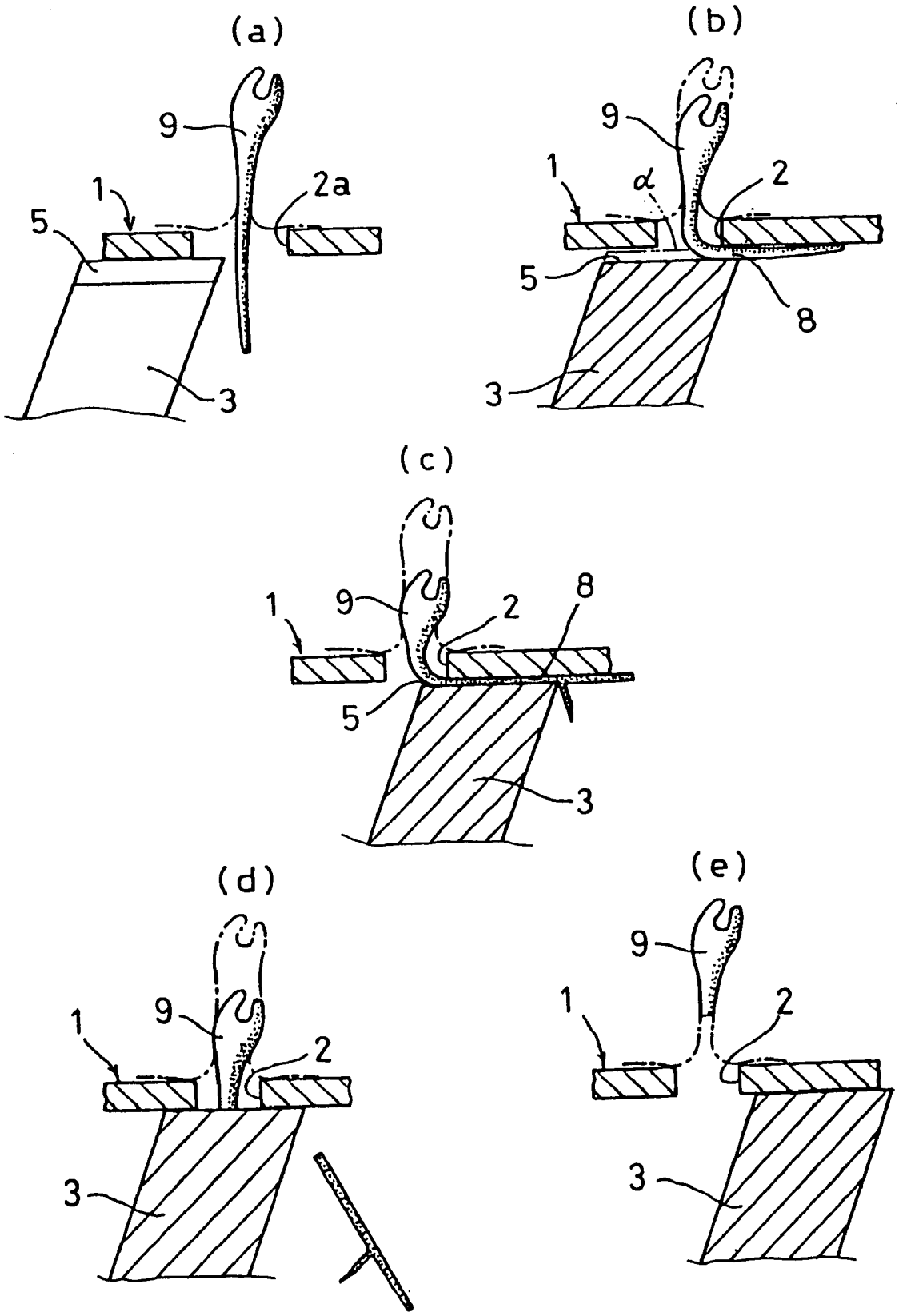
FIGS. 8: *a~e* are a section view along the same direction as the FIG. 6 showing the cutting process of the hairs.

Thus, based on the FIG. 7 anti FIG. 8, the cutting process of the hairs 9 guided into the port 2 will be here explained. The FIG. 7 shows the cutting process of the hairs 9 guided into the port 2, wherein the section figure from the front of the adjacent part in the same manner as in the FIG. 5, namely the FIG. 8(*a*)~(*e*) shows the section view of the hairs 9 in each step of the FIG. 7, seen from the side of the same adjacent part as in the FIG. 6.

When the outer blade 1 of the shaver is moved along the skin, the hairs 9 will be guided into the port 2 in an arbitrary region. However, in this example, there is formed the part 2*a* with a large width, of the port 2 on the outer side of the outer surface of the adjacent part provided with the escaping gap 8 so that many hairs 9 will be first guided into the region comprising the escaping gap 8 in the outer part. For the convenience of the illustration, hairs 9 guided into the part 2*a* with a large width, of the port 2 as shown in the FIG. 8(*a*) will be first guided into the region comprising the escaping gap 8 in the outer side and afterwards, these hairs will be cut upon moving into the region without an escaping gap 8 in the inner part.

As shown in the FIG. 8(*b*), the hairs 9 guided into the region of the escaping gap 8 are pinched by the escaping gap 8 and with the moving of the inner blade 3 they are taken out from the root of hair and upon moving into the narrow escaping gap 8 of the inner part as in the FIG. 8(*c*), the hairs 9 will be more strongly pinched by the escaping gap 8, wherein the hairs get hooked upon the tip of the inner blade 3, more largely enough taken out from the root of hair than the thickness of the outer blade 1.

As shown in the FIG. 8(*d*), after the hairs 9 move further into the region without an escaping gap 8 in the inner side, the hairs 9 are to be cut in a deep position on the side of the root of hair by means of the subsequent inner blade 3 while being largely taken out from the root of hair. While the preceding inner blade 3 has left and the subsequent inner blade 3 comes to the position of the port 2, the hairs 9 are left undone without being taken out, however the inner blade 3 keeps rotating at a high speed, thus the time of those steps is short, wherein the hairs 9 returning relatively slowly to the root of hair are to be cut in the sufficiently deep position.

As shown in the FIG. 8(*e*), the hairs 9 after being cut and left undone without being taken out, slowly return to the root of hair so that they stay deeply cut into inside the skin.

The hairs 9 guided into the region without an escaping gap inside the inner part from the beginning, will be cut without being taken out, but when the shaver is used, the outer blade 1 is pressed to the skin while moving the shaver repeatedly, and while the tip of the hair thus cut gets out into the region where the escaping gap 8 is formed as the outer blade 1 moves repeatedly, the hairs are to be cut deeply by the same effects as in the cutting process of the hairs 9 guided into the region of the escaping gap 8.

Thus, by forming the escaping gap 8, the effects of securely carrying out the deep cutting is obtained and the escaping gap 8 decreases as it gets closer to the region where there is no escaping gap 8 (see the FIG. 5) and the hairs 9 will be strongly pinched as they gets closer to the region where there is no escaping gap 8, thus increasing the force of taking the hairs out from the root of hair, with effects of further cutting deeply.

On the escaping surface 5 shown in the FIG. 5, the FIG. 6(*a*), the FIG. 7 and the FIG. 8(*b*) with the virtual line, there may be formed an introducing material α for introducing the hairs 9 in such a manner as to close the space between the upper side of the said escaping surface 5 and the inner side of the outer blade 1.

The introducing material α comprises the resilience of rubbers, soft resins or soft and porous materials like sponges or alternatively friction deforming material, however, in this example, the introducing material α is fixed on the side of the escaping surface 5.

The introducing material α prevents the hairs 9 guided into the inner part of the outer blade 1 from escaping from the port 2 by its friction.

The effects of the introducing material α being installed will be explained according to the FIGS. 7 and 8.

When the outer blade 1 of the shaver is moved along the skin, the hairs 9 will be introduced in an arbitrary region of the port 2.

As shown in the FIG. 8(*a*), the hairs 9 guided into the inner part of the outer blade 1 from the port 2 of the outer blade 1, will be in contact with the introducing material α as the shaver in time of shaving moves, thus preventing them from escaping from the port 2 by the friction of the introducing material α, wherein, as shown in the same FIG. (*b*), the introducing material α changes its position toward the pressing direction with the hairs 9, which will be pinched between the inner part of the outer blade 1 and the escaping surface 5, taking them out a little bit from the root of hair as the inner blade 3 moves, in such a manner that, as shown in the FIG. 8(*c*) subsequently, the hairs 9 will be pinched between both blades 1 and 3 strongly after they have moved to the part where there is less introducing material α while being hooked on the tip of the inner blade 3, thus being taken out from the root of hair more largely than the thickness of the outer blade 1.

Subsequently as shown in the FIG. 8(*d*), when the hairs 9 move to the region where there is no introducing material α in the inner parts, they will be cut deeply on the side of the root of hair with the subsequent inner blade 3 while being largely taken out from the root of hair. Thus, as shown in the FIG. 8(*e*), the hairs 9 cut and released from the force of taking out, return slowly to the root of hair to be deeply shaven into the inner side of the skin.

In this way, when the introducing material α is provided, even downy or soft hairs will be sufficiently introduced inside the outer blade 1 by its friction and afterward, they are taken in between both blades 1 and 3, so that they can be easily cut deeply, with good effects for feminine use.

In addition, when the introducing material α is provided in such a manner as to close the space between the facing outer blade 1 and inner blade 3, the hairs 9 guided into the inner parts of the outer blade 1 can be taken so that they cannot escape from the port 2, in order to be cut, using the introducing material α with a closing structure.

Furthermore, when the introducing material α is formed of the elastic material, soft resin or soft and porous materials, an introducing material which is appropriate and arbitrary may be selected depending on the different types of the shavers, with blades rotating or moving back and forth adjacently or the different uses of the shaver (the region to shave beards in).

Additionally, an introducing material α may be provided in all escaping surfaces 5 (amounting to twelve surfaces) of each inner blade 3 as shown in the FIG. 3, or alternatively, the introducing material α may be provided against every but one escaping surface 5, thus partially.

Figure 9:
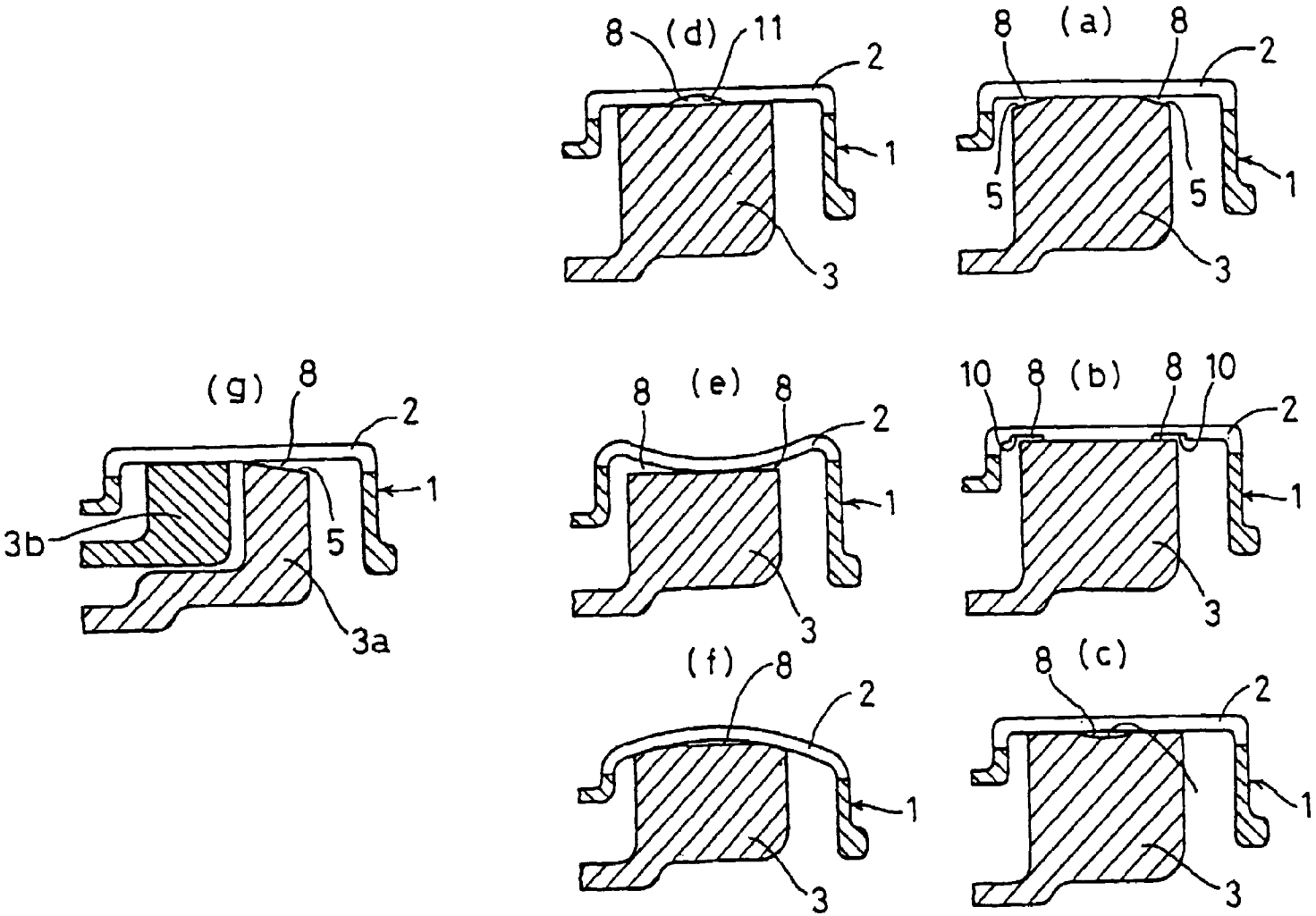
FIGS. 9: *a~g* are the section views of other examples of the escaping structure.

The FIG. 9 shows another example of the escaping gap 8, wherein the same figure (*a*) comprises the escaping surface 5 on both sides, inner and outer, of the inner blade 3, thus forming the escaping gap 8 on both sides, inner and outer, of the port 8. (*b*) comprises the escaping step 10 on both sides, inner and outer, of the inner parts of the outer blade 1, thus forming the escaping gap 8 on both sides, inner and outer. (*c*) comprises an escaping concave part 11 in the shape of an arch, in the center of the inner blade 3, thus forming the escaping gap 8 in the center of the port 2. (*d*) comprises the escaping concave part 11 in the shape of an arch, in the center of the inner part of the outer blade 1, thus forming the escaping gap 8 in the center part. (*e*) comprises the outer blade 1 warped in the shape of the concave for getting pressed to the skin while the tip of the inner blade 3 is flat, thus forming the escaping gap 8 on both sides, inner and outer.

(*f*) comprises the outer blade 1 warped in the shape of the convex while the center part of the tip of the inner blade 3 is flat along the warping surface, thus forming the escaping gap 8 in the center. In (*g*), the inner blade 3 is divided along the radius direction and for the width of the tip of the inner blade 3*a* on the outer side of the divided blade, there is provided the escaping surface 5, wherein the end part of the inner blade 3*b* is flat in its inner side, thus forming the escaping gap 8 on the outer surface of the port 2 adjacent to the inner blade 3*a*.

Even though thus constructed, roughly the same operations and effects can be obtained so that the same signs will be put for the same parts as in the previous figures and more detailed explanations will be omitted.

Furthermore, in the FIG. 9, there may be provided the introducing material α in each of the escaping gaps 8.

In this case, in the FIGS. 9(*a*), (*c*), (*e*), (*f*), (*g*), the introducing material α is fixed on the side of the inner blade 3 and in the FIGS. 9(*b*) and (*d*), the introducing material α may be fixed on the side of the outer blade 1.

Furthermore, the introducing material α may not always have to be installed in such a way as to close the space between the outer blade 1 and the inner blade 3 and the introducing material α may be provided in such a way as to form clearance on one side of the space between the outer blade 1 and the inner blade 3 (the said one side indicates the free end against the end fixed part of the introducing material α) and in this case, for the introducing material α, the elastic material, the soft resins, the soft porous materials and other adhesive agents (including those agents having absorbed the elastic materials, soft resins, soft porous materials), may be used, wherein the said adhesive power can introduce especially downy and soft hairs, thus reducing the friction of those adjacent blades 1 and 3 by formation of the clearance.

Figure 10:
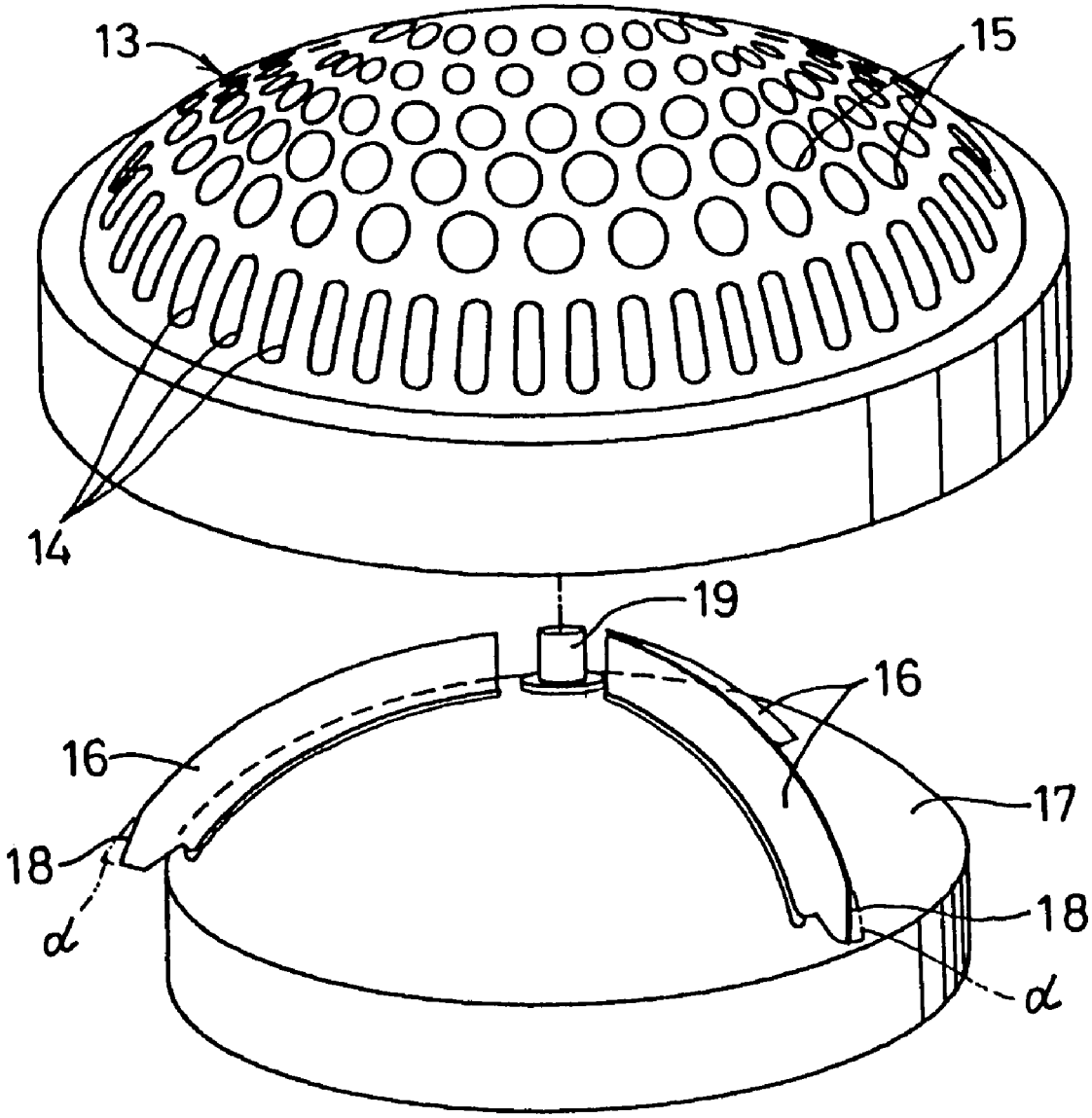
FIG. 10: a break-down perspective view of more other examples of the shaver
Figure 11:
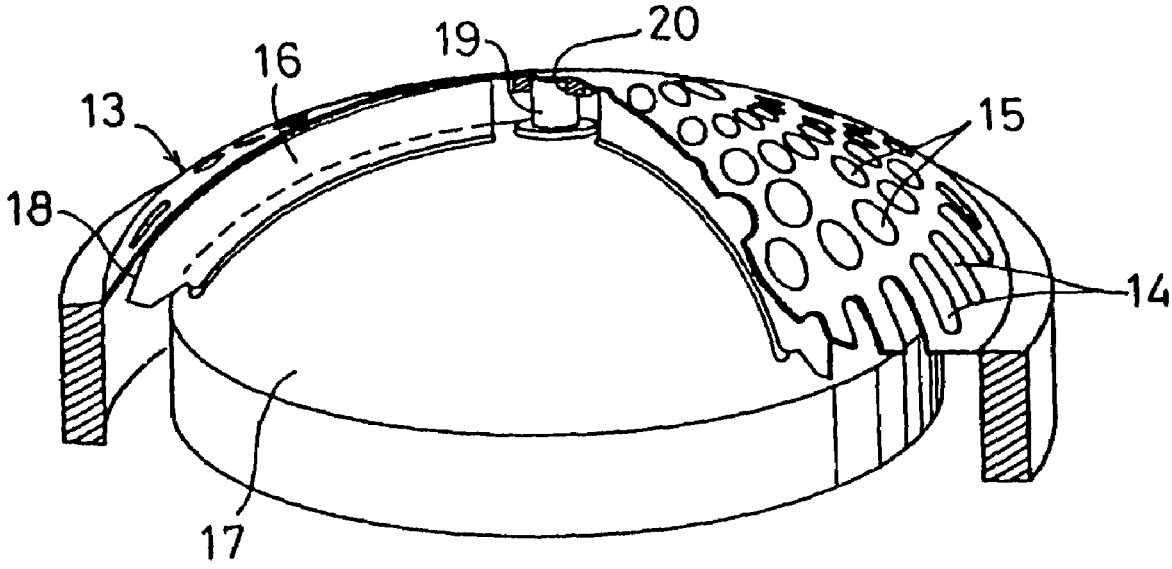
FIG. 11: a cut out perspective view of the outer and inner blades of the FIG. 10 being composed
Figure 12:
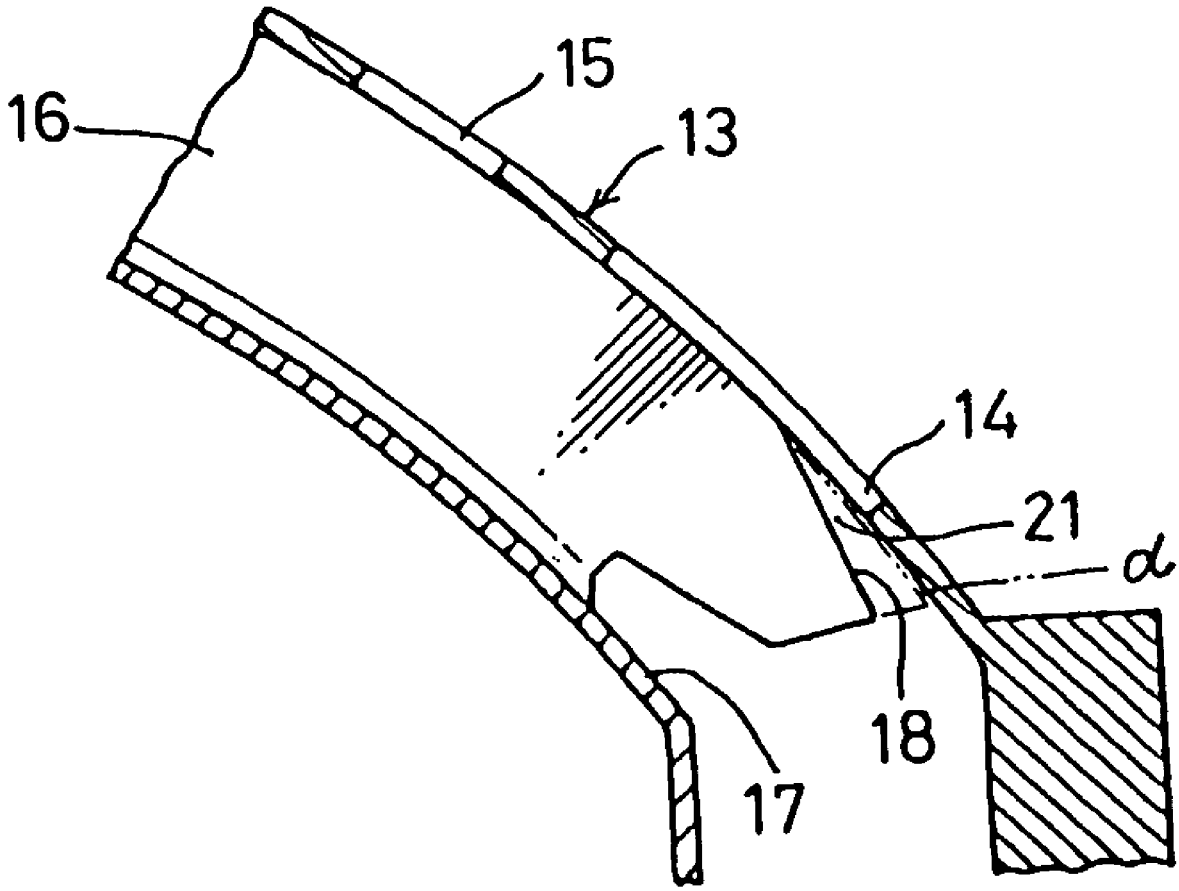
FIG. 12: a magnified section view of the main part along the direction of the radius in the FIG. 11

The FIGS. 10–12 show more other examples. The shaver of the present invention is also a rotating cutter, wherein the outer blade 13 is formed in the shape of a dome as a fixed blade to touch directly the skin as shown in the FIG. 10 and the ports 14 are installed radially in the long round shape on its outer circumference, together with many ports 16 in the round shape in the center of the inner side. Three of the inner blades 16 as moving blades are radially installed on the surface of the disk 17 in the shape of a dome to be rotated and driven in a given direction, together with the escaping surface 18 going down toward the outer side in the direction of the radius, on the end outer side of each inner blade 16.

The inner blade 16 as shown in the FIG. 11 is composed against the outer blade 13 so that the cutting blade provided on the tip of the inner blade is located adjacent to the inner part of the outer blade 13 on which each port 14 and 15 is installed and the hairs will be cut by means of the cutting blade provided on the inner port edge of each port 14 and 15 together with the cutting blade of each inner blade 16. In addition, the protrusion 19 provided in the center of the disk 17 is encased in the hole 20 provided in the center of the inner part of the outer blade 13 in such a way to be freely rotated, thus preventing the inner blade 16 from going away from the axle.

As shown in the FIG. 12, in the outer circumference in the direction of the radius, of the inner blade 16, there is provided an escaping gap 21 decreasing toward the outer side, between the outer blade 13 and the inner blade 16 with the escaping surface 18. Therefore, the hairs guided into the port 14 on the outer circumference on the adjacent part of the inner blade 16 will be pinched by the escaping gap 21 and taken out from the root of hair and upon moving to the region where there is no escaping gap 21 on the inner side, they will be cut in a deep position.

Even in the above examples, the introducing material 60 may be provided on the escaping surface 18 as shown with the virtual line in the FIGS. 10 and 12.

Figure 13:
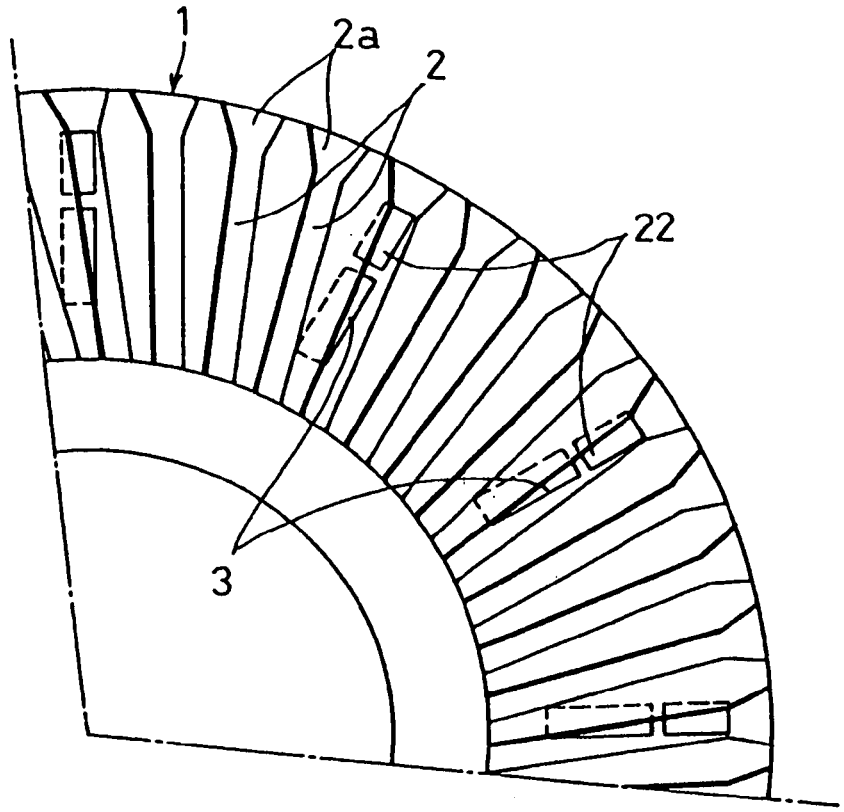
FIG. 13: *a* is a partly omitted plan view of other examples of the shaver and *b* is a magnified section view of the main part along the direction of the radius thereof.
Figure 13:
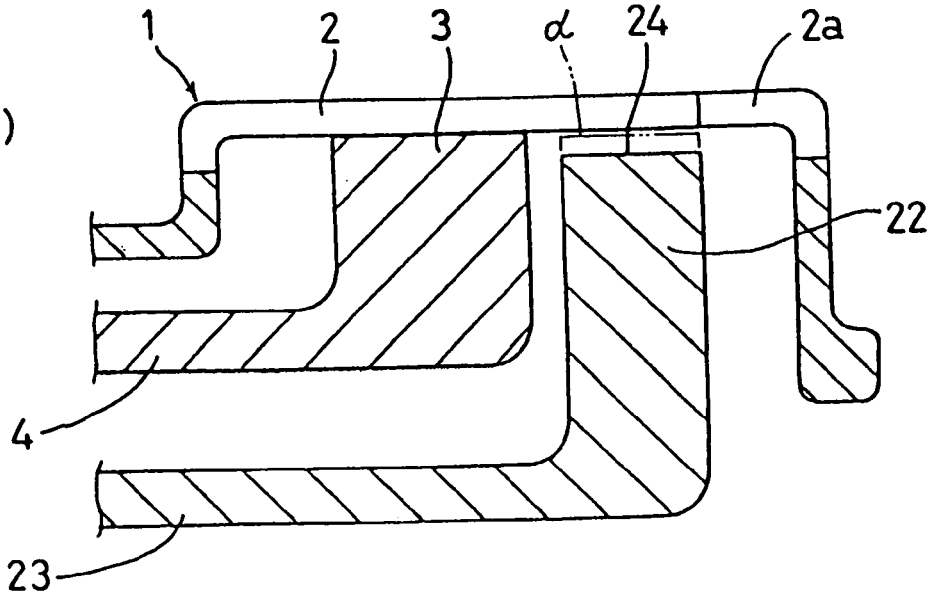

The FIG. 13 shows more other examples. This shaver, as in the FIG. 1, constitutes the rotating cutter comprising three outer blades 1 on its tip, wherein as shown in the FIGS. 13(*a*) and (*b*), the end part is flat and on the outer circumference of each inner blade 3 adjacent to the inner part of the outer blade 1 with the whole width, there is provided the assisting material 22 for taking out the hairs, which material is a metal rotating one, which rotates together with the inner blade 3.

The assisting material 22 is installed on the other disk 23 installed on the same rotating axle as the disk 4, in the same position as the inner blade 3, radially and its end part 24 is located adjacent to the inner part of the outer blade 1 with a given distance.

Even though thus constructed, the assisting material 22 can take the hairs 9 from the root of hair, wherein the hairs 9 can be cut in a deep position with the said inner blade 3 when the hairs 9 move the inner blade 3. Alternatively, the end part 24 of the assisting material 22 is formed with a rough surface so that the hairs 9 can be more easily taken in by the friction and by providing the introducing material α into the end part 24 as shown in the FIG. 13(*b*), the shaver may be so constructed as to cut the soft hairs deeply upon taking them.

Alternatively, the assisting material 22 may be the rigid material, which does not warp and possibly made of the material whose form is plastically changeable.

Figure 14:
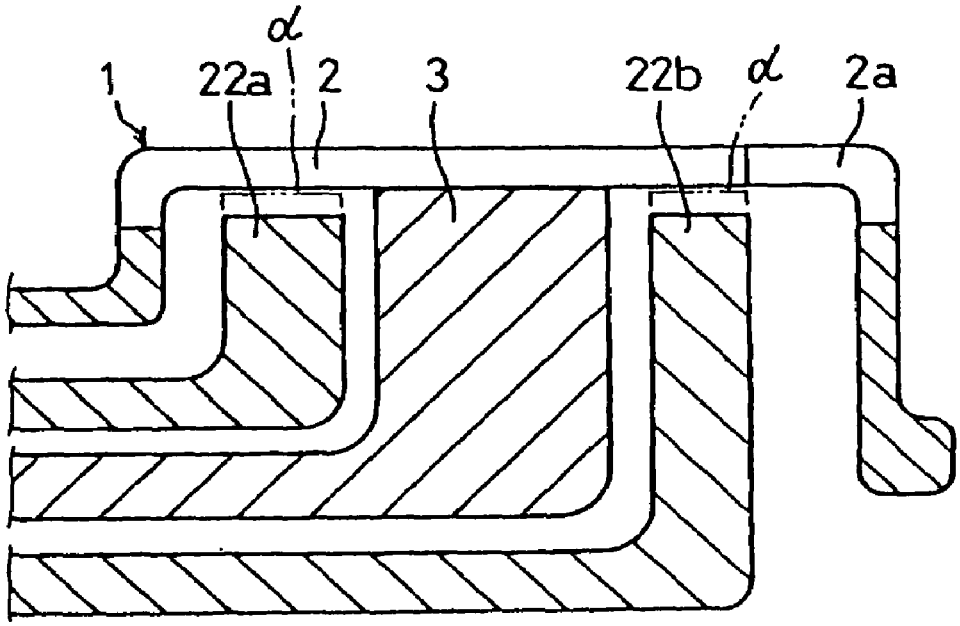
FIG. 14: *a, b* are the section view of more other examples of the shaver.
Figure 14:
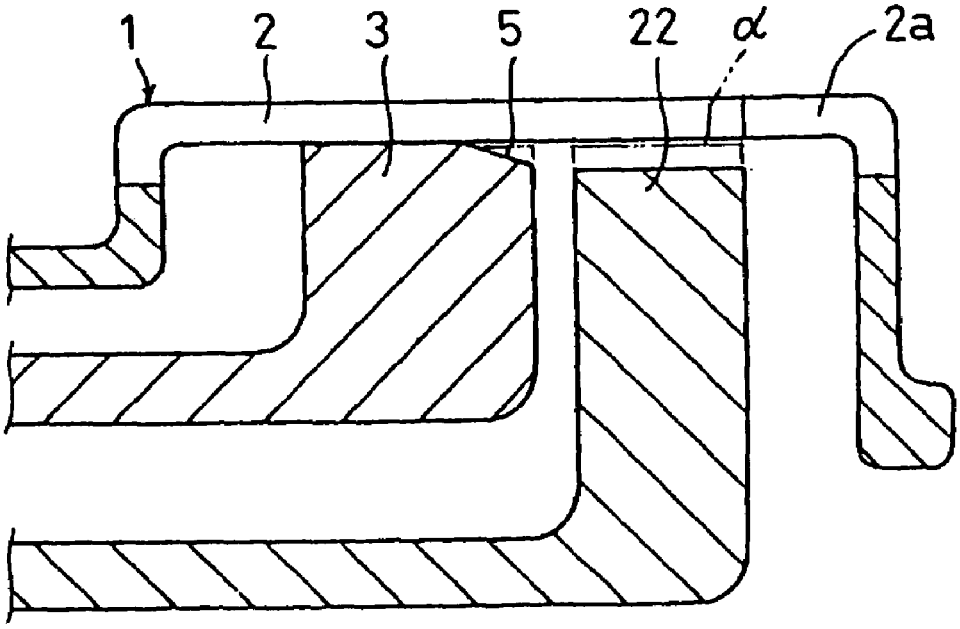

The FIG. 14(*a*), (*b*) show more other examples. (a) shows an example, in which the assisting materials 22*a* and 22*b* are provided on both inner and outer circumferences and (b) shows an example in which, on the outer side end of the inner blade 3, there is provided the escaping surface 5 so that the assisting material 22 and the escaping surface 5 are both used to take out the hairs.

Even though thus constructed, the hairs 9 can be favorably taken in for the deep) cutting. Alternatively, in the FIGS. 14(*a*) and (*b*) there is provided the introducing material α as shown with the virtual line for taking in soft hairs for the deep cutting.

Figure 15:
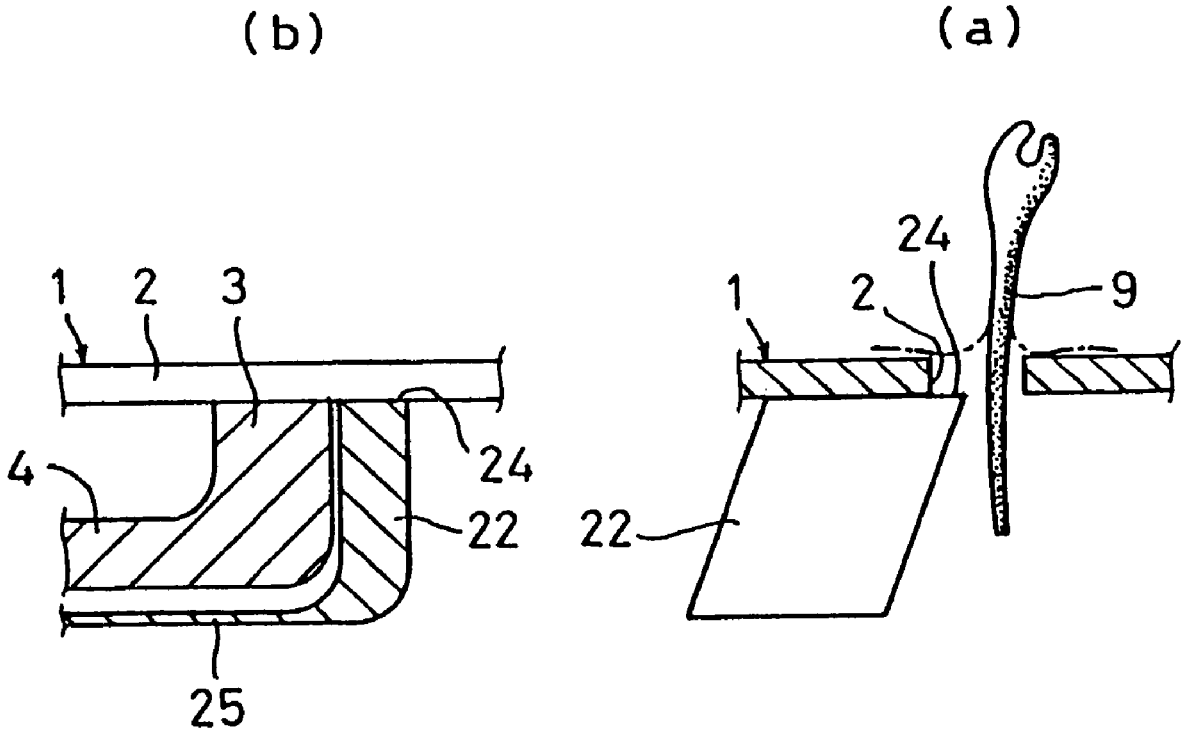
Figure 16:
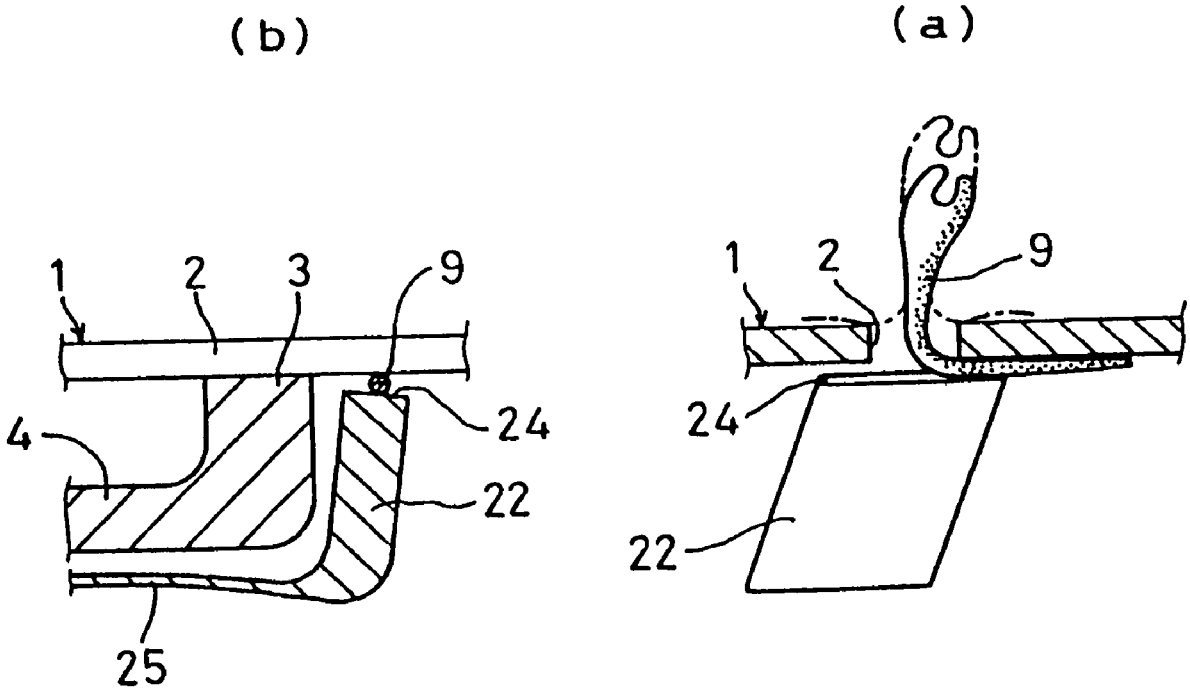
FIG. 16: *a* is a section view of the assisting material of the FIG. 15 having taking out the hairs and *b* is a section view from the side of *a*.

The FIGS. 15 and 16 show more other examples. According to the shaver of the present invention, the assisting material 22 provided on the outer circumference of the inner blade 3 as shown in the FIGS. 15(*a*) and (*b*) is installed on the tip of the arm material 25 made of metal and the end part 24 is located adjacent to the inner part of the outer blade 1. The arm material 25 is installed radially on the same rotating disk attached to the same rotating axle as the disk 4.

In this case, when the hairs 9 guided into the port 2 enter the space between the end part 24 of the assisting material 22 and the inner part of the outer blade 1 as shown in the FIG. 16(*a*), the arm material 25 gets warped as shown in the FIG. 16(*b*) and while the space between the end part 24 and the outer blade 1 is forcibly spread and the assisting material 22 gets resilient by the spring force of the material 25, the hairs 9 is pinched with the inner space of the outer blade 1 and thus taken out from the root of hair.

In this way, when the assisting material 22 is added resilience toward the inner part of the outer blade 1 by the spring means, the hairs 9 guided into the position of the assisting material 22 will be more favorably pinched between the assisting material 22 and the outer blade 1 by the resilient force in order that they will be taken out from the root of hair and after the hairs 9 have been taken out by the subsequent inner blade 3, they will be cut in a more deep position for a more deep shaving.

Figure 17:
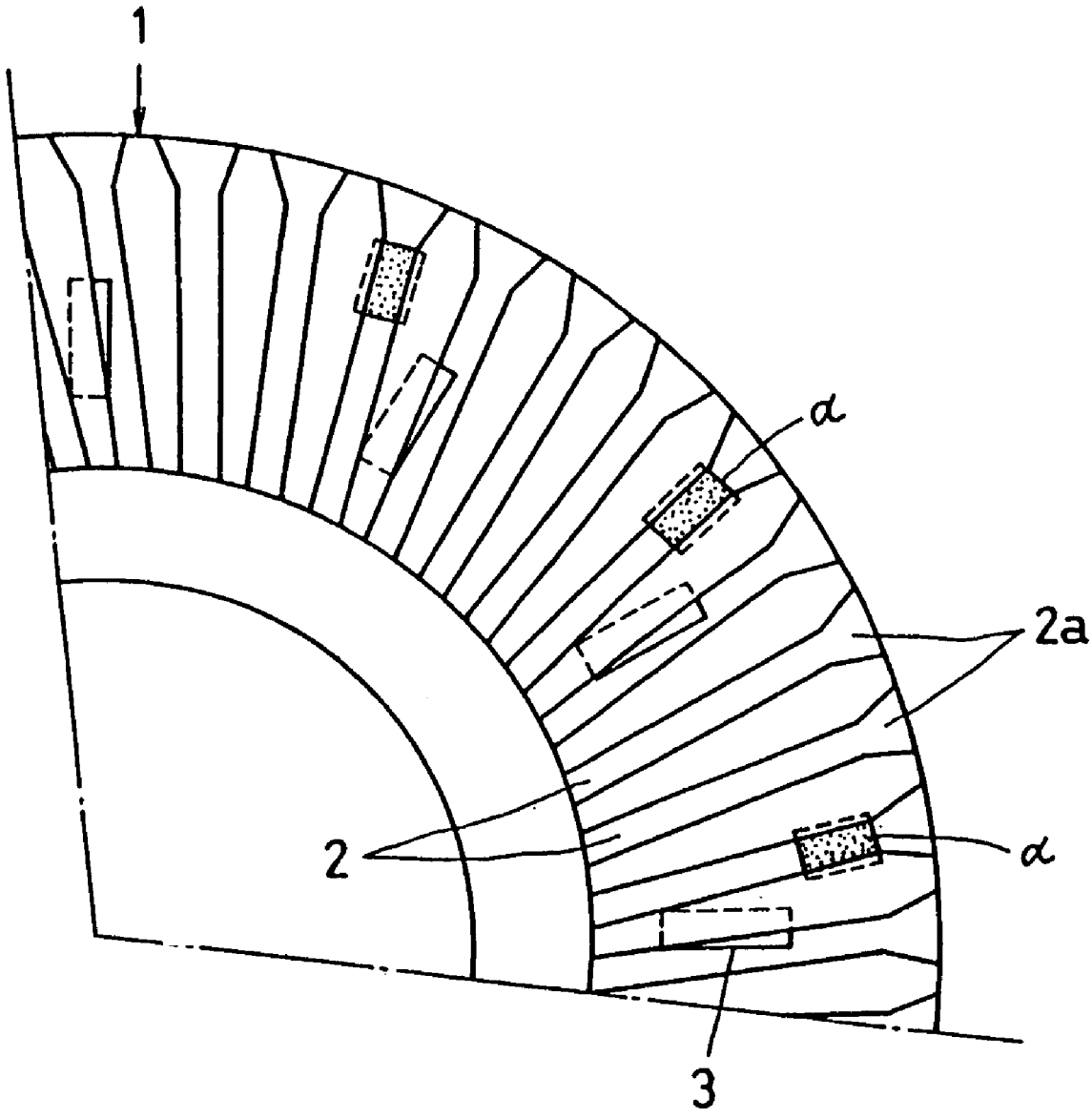
FIG. 17: A plan view of the main part of more other examples of the present invention

The FIG. 17 shows another example of the shaver, according to which the assisting material 22 is installed on the preceding side of the inner blade 3, together with the assisting material α on the end part of the assisting material 22.

In this way, on the preceding side of the inner blade 3 there is provided the assisting material 22, together with the introducing material α between the assisting material 22 and the outer blade 1, and thus, the hairs guided into the inner part of the outer blade 1 from the port 2 are to be taken first by the preceding introducing material α in order to be cut by the inner blade 3 subsequent to the assisting material 22 after the hairs have been taken there, thus obtaining a deeper shaving.

Alternatively, even in the example shown in the FIG. 17, other constructions, operations and effects are the same as the examples in the FIGS. 13(*a*) and (*b*) so that the same signs are put for the same parts in the FIG. 17 as in the FIG. 13, omitting more detailed explanations, however, the shaver may be so constructed that the hairs may be taken in by the assisting material 22 while omitting the introducing material α, for a deeper shaving.

Thus, in the example of the FIG. 17, the assisting material 22 is installed out from the inner blade 3 in the direction of the radius and on the further side (the preceding side), and the assisting material 22 may be installed out from the inner blade 3 and also on the latter side or alternatively the assisting material 22 may be provided on the inner side of the inner blade 3 and on both preceding and subsequent side or the combination of each of these examples can be adopted.

Figure 18:
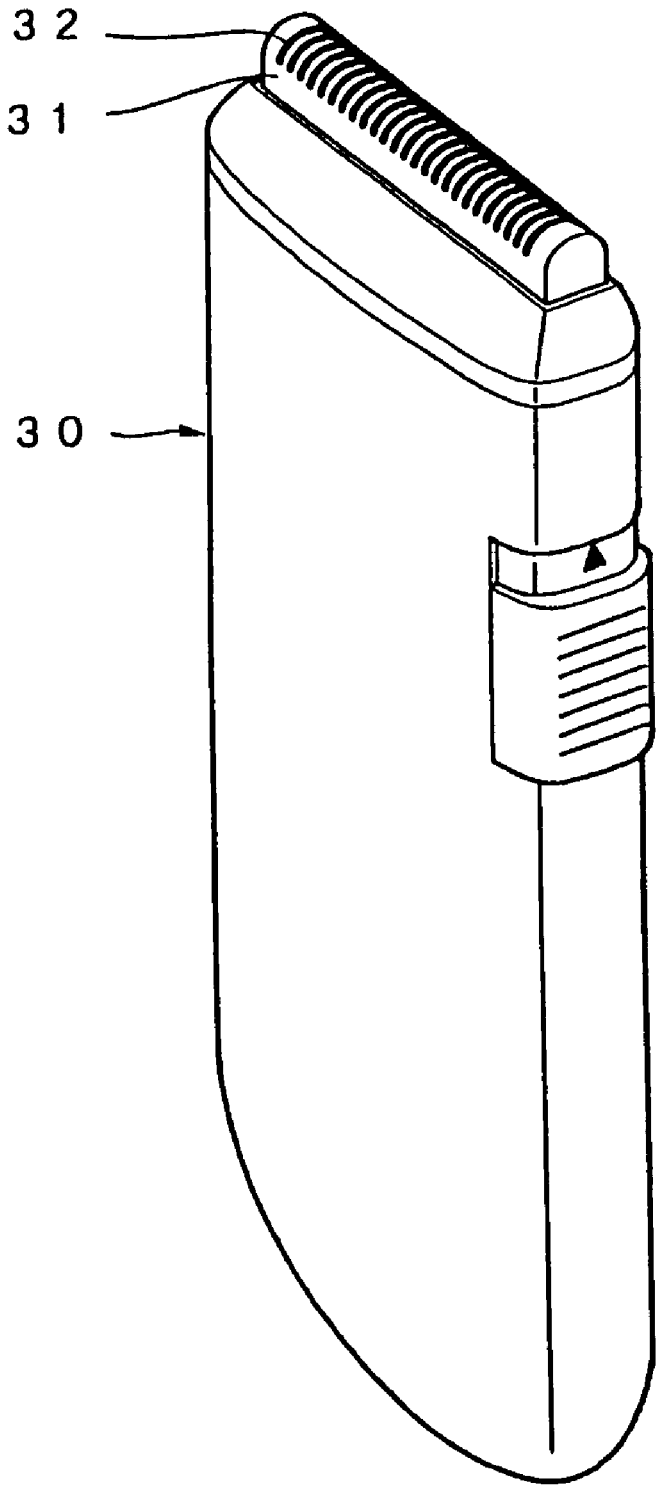
FIG. 18: A perspective view of the shave of more other examples of the present invention
Figure 19:
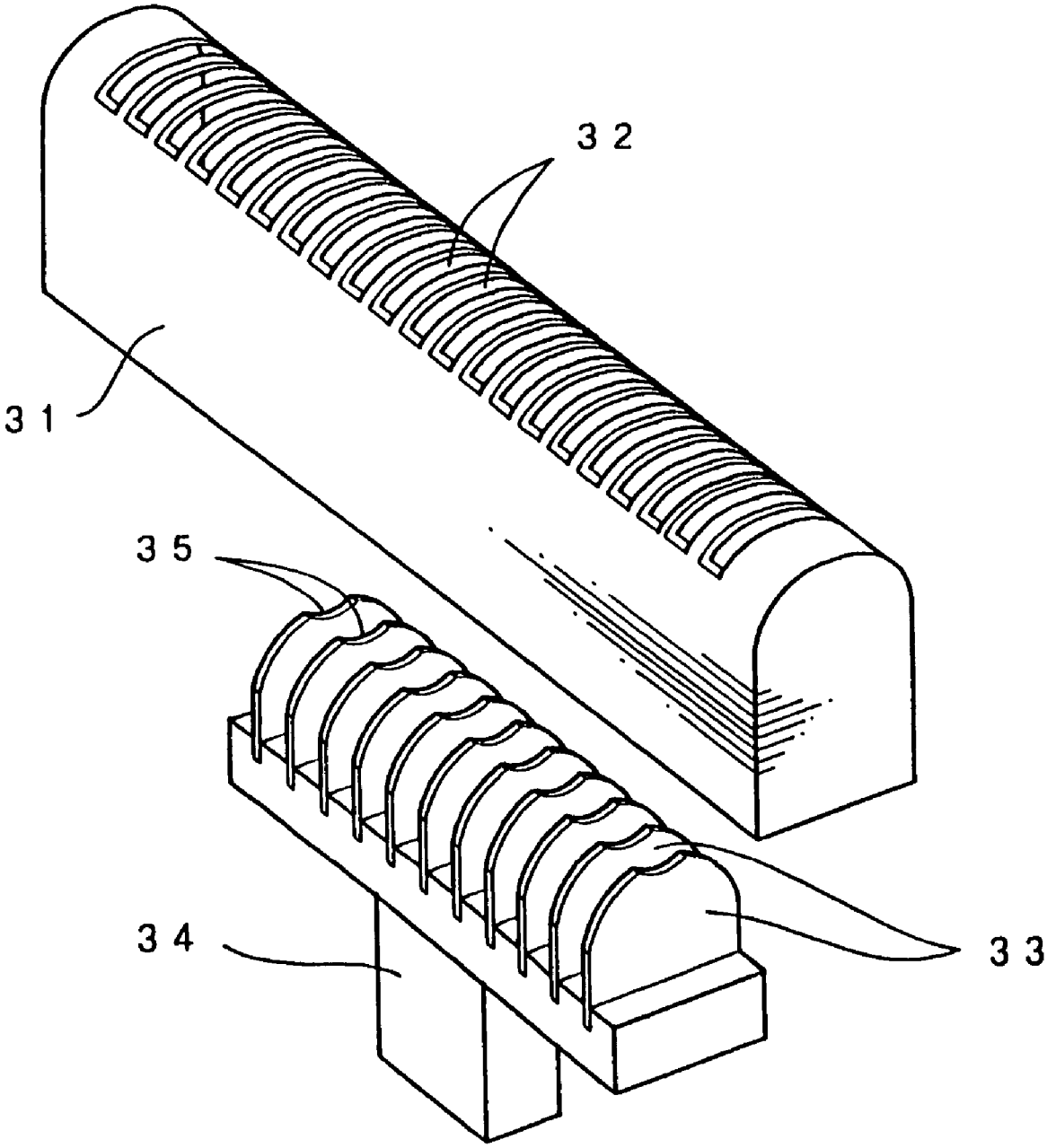
FIG. 19: A break-down perspective view of the main part of the FIG. 18
Figure 20:
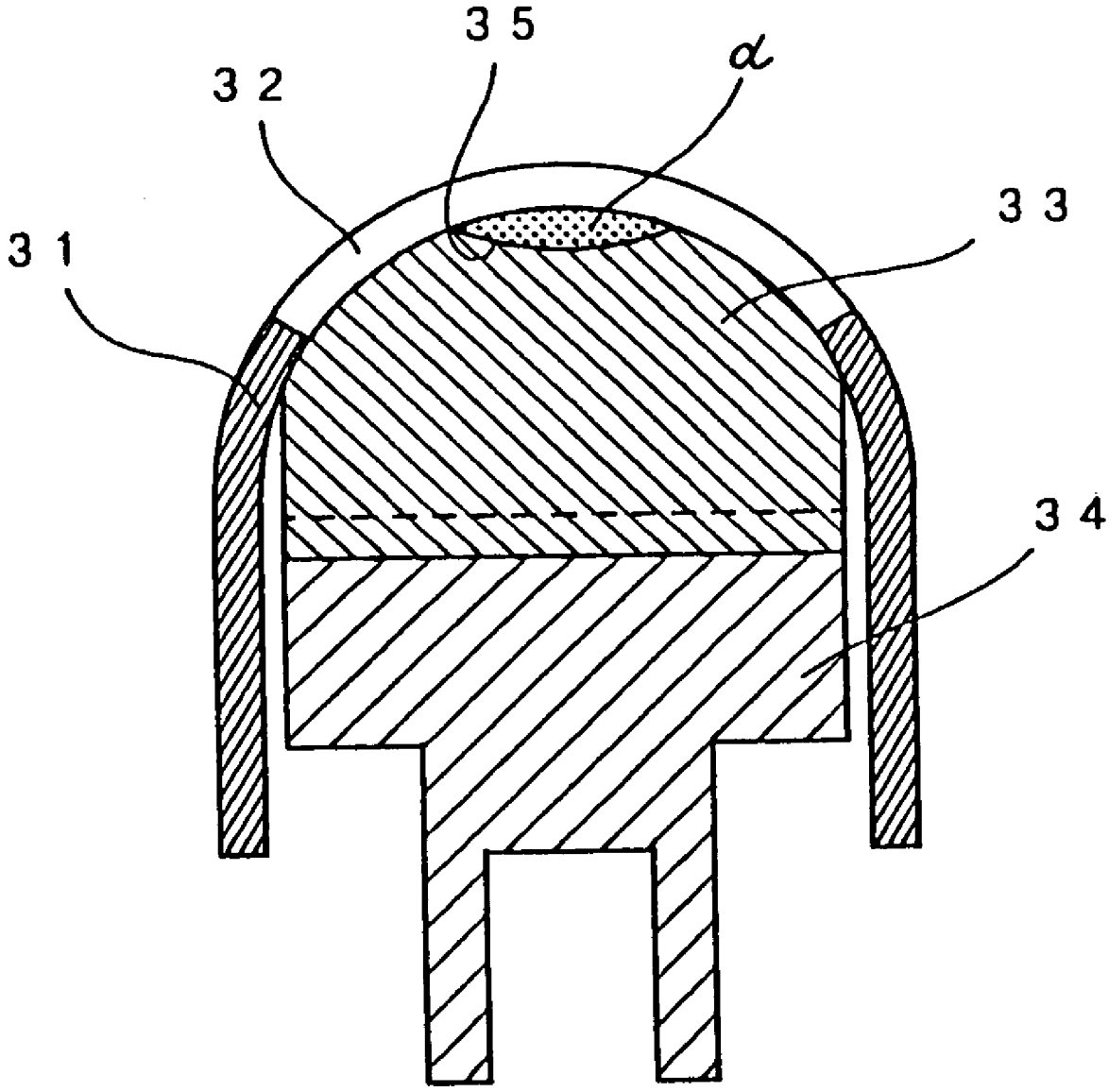
FIG. 20: A section view of the outer and inner blades being composed

The FIGS. 18~20 show more other examples of the shaver and in these figures, the shaver of motion moving back and forth adjacently is shown.

In other words, the shaver is provided with the shaver body 30, the outer blade 31 having each of many ports 32 . . . formed in parallel in the shape of an arch corresponding to the top shape (roughly in the shape of an arch) of the outer blade and many inner blades 33 moving back and forth adjacently along the inner part of the outer blade 31, together with the slider 34 installed with each inner blade 33.

The escaping concave 35 is formed in the warping shape in the middle of the upper middle side of each inner blade, wherein each escaping concave part 35 is provided with the introducing material α each. (Except for the FIG. 19 in which the introducing material α is not shown for the purpose of clearly showing the shape of the inner blade 33.)

Figure 21:
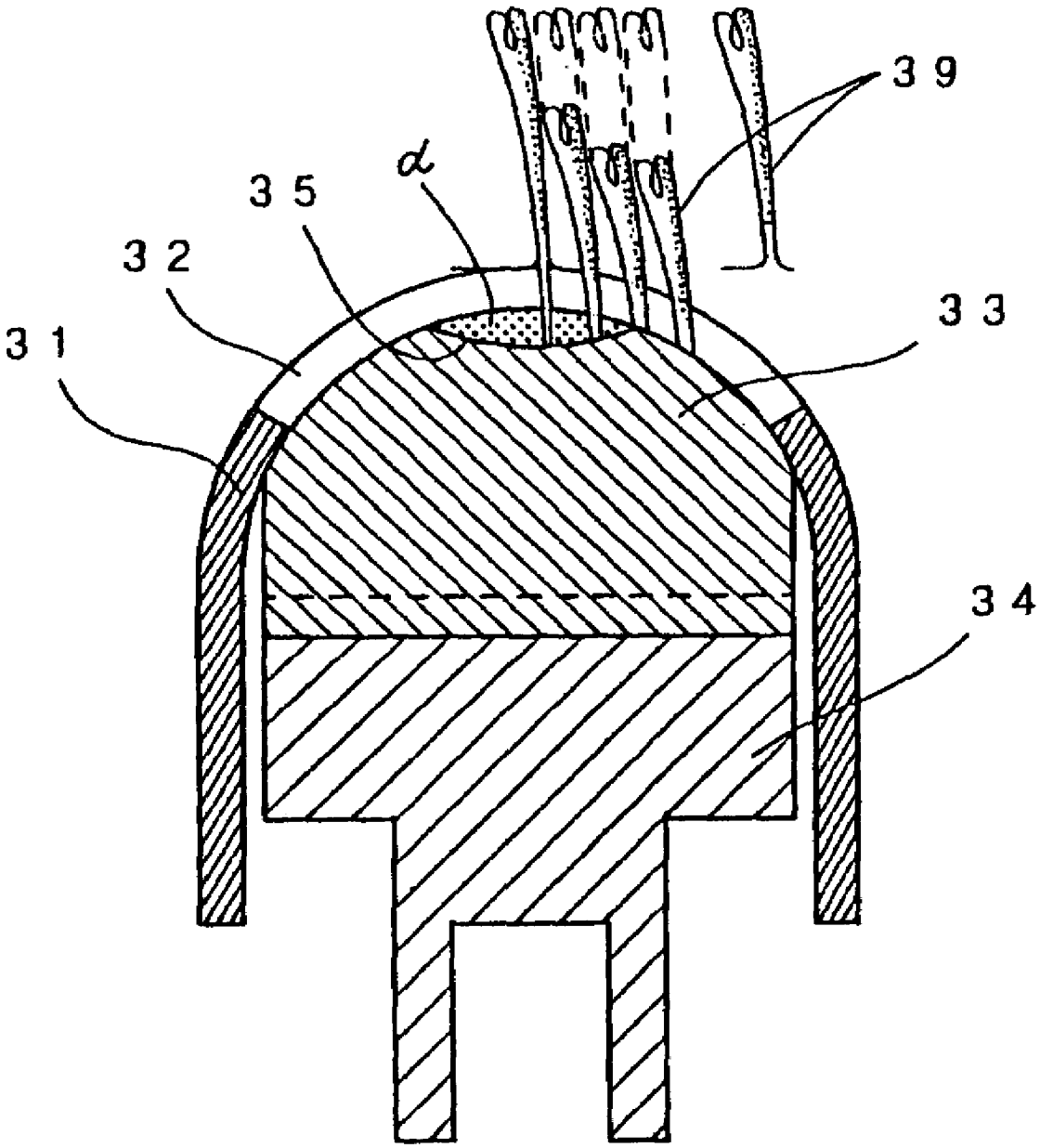
FIG. 21: A section view of the cutting process of the hairs
Figure 22:
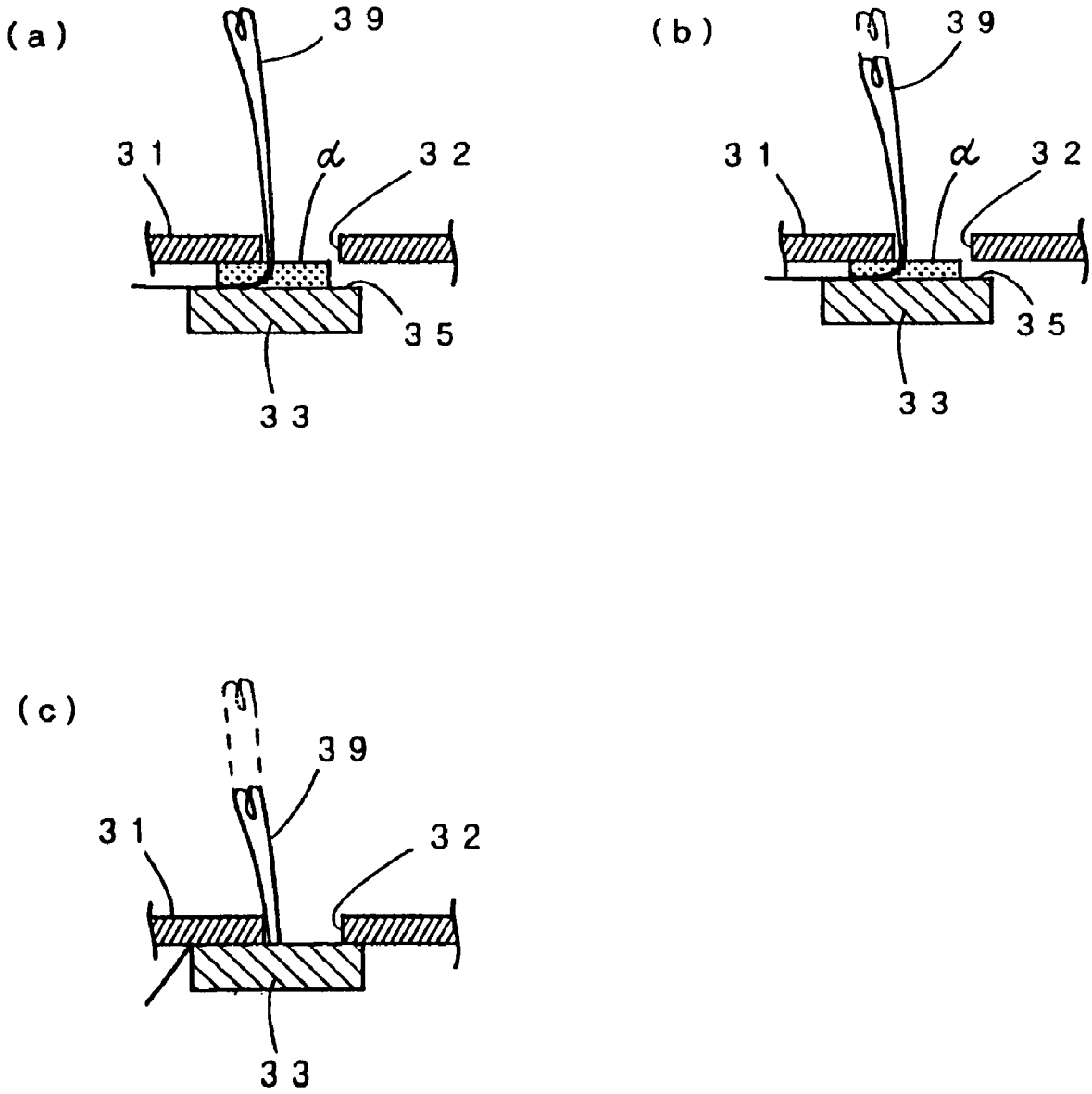
FIG. 22: A section view of the cutting process of the hairs

From now on, according to the FIGS. 21 and 22, the cutting process of the hairs 39 guided into the port 32 will be clarified.

The hairs 39 guided into the inner part of the outer blade 31 from the port 32 of the outer blade 31 will contact or be inserted into the introducing material α as shown in the FIG. 22(*a*) during the moving of the shaver in shaving, and the friction resistance of this introducing material α prevents the hairs fleeing away from the port 32, while the hairs are to be pinched between the inner part of the outer blade 31 and the escaping concave part 35 and with the move of the inner blade 33, the hairs are taken out from the root of hair a little bit with the transference of the inner blade 33 as shown in the FIG. 22(*b*) and as they move to the part where the volume of the introducing material α is small, the hairs 39 will be pinched strongly between both blades 31 and 33 and afterward, they will be hooked by the tip of the inner blade 33 and taken out from the root of hair more largely than the thickness of the outer blade 31.

Furthermore, as shown in the FIG. 22(*c*), when the hairs 39 move to the region where there is far more little introducing material α, the hairs 39 will be taken out from the root of hair and in the meantime they will be cut with the subsequent inner blade 33 deeply on the side of the root of hair. While the preceding inner blade 33 has left and until the subsequent inner blade 33 reaches the port 32, the hairs 39 will be left undone without being taken out, however, as the inner blade 33 is moving rapidly and adjacently, the time for these steps is very short and the hairs 39 go back to the root of hair so slowly that they will be cut in a deep position.

The hairs 39 returns to the root of hair slowly once they are left undone without being taken out and they will be kept deeply shaven into the inner side of the skin.

In this way, even when the shaver is adapted for the type of the shaver of motions consisting in going back and forth adjacently, it will have the same operation as in the case of the rotating shaver and the introducing material α prevents the hairs 39 from fleeing away from the port 32, thus providing for an easy cutting and deep shaving.

In addition, the introducing material α may be omitted while the part of the escaping concave 35 is provided for the escaping space so that hairs 9 will be taken out from the root of hair for a deep shaving.

Figure 23:
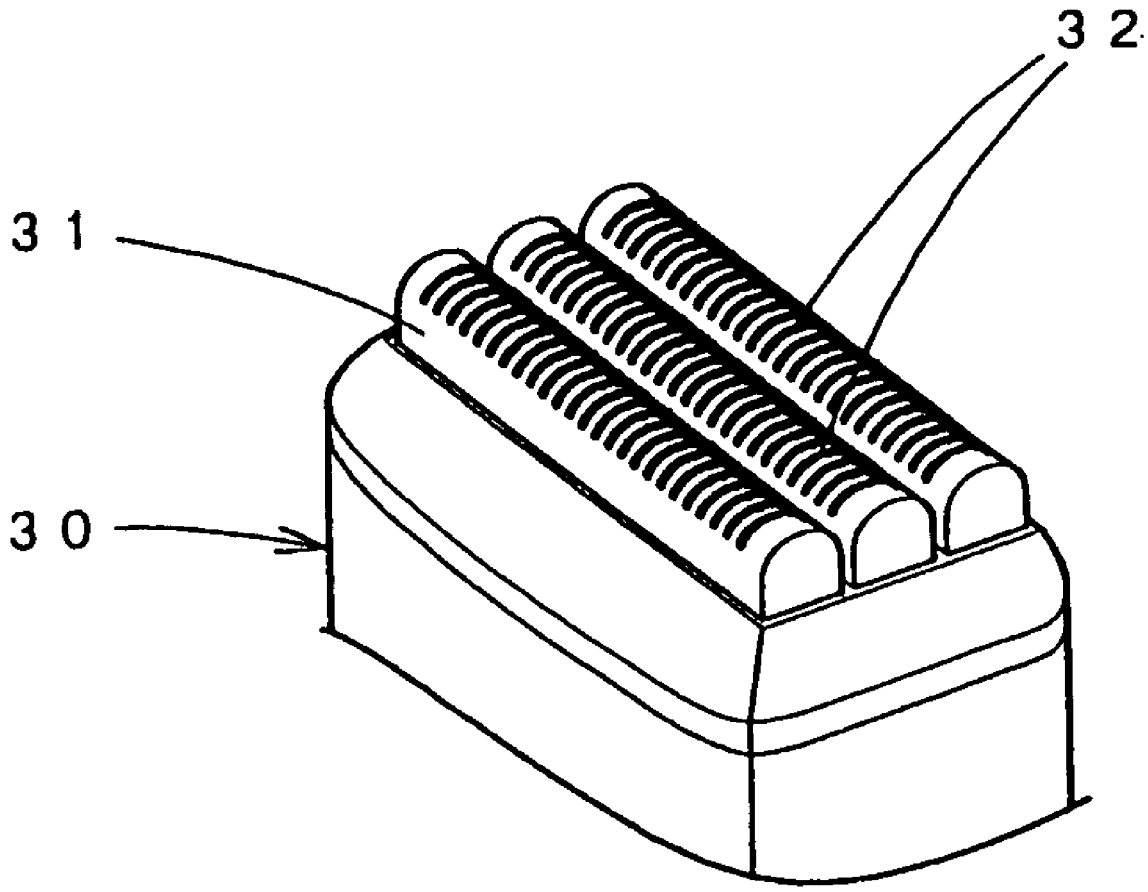
FIG. 23: A partial perspective view of more other examples of the present invention

The FIG. 23 shows another example of the shaver, wherein, in comparison with the shaver of a single outer blade structure, the shaver is constructed with a plurality of outer blades having an inner structure as shown in the FIGS. 19 and 20. Even though thus constructed, the same shaver has the same operations and effects as the examples shown in the FIGS. 18~22 so that the same signs are put for the same part in the FIG. 23 as in the previous figures, thus omitting detailed explanations.

The FIGS. 24~27 shows more other examples of the shaver of motion consisting in moving back and forth adjacently.

Figure 24:
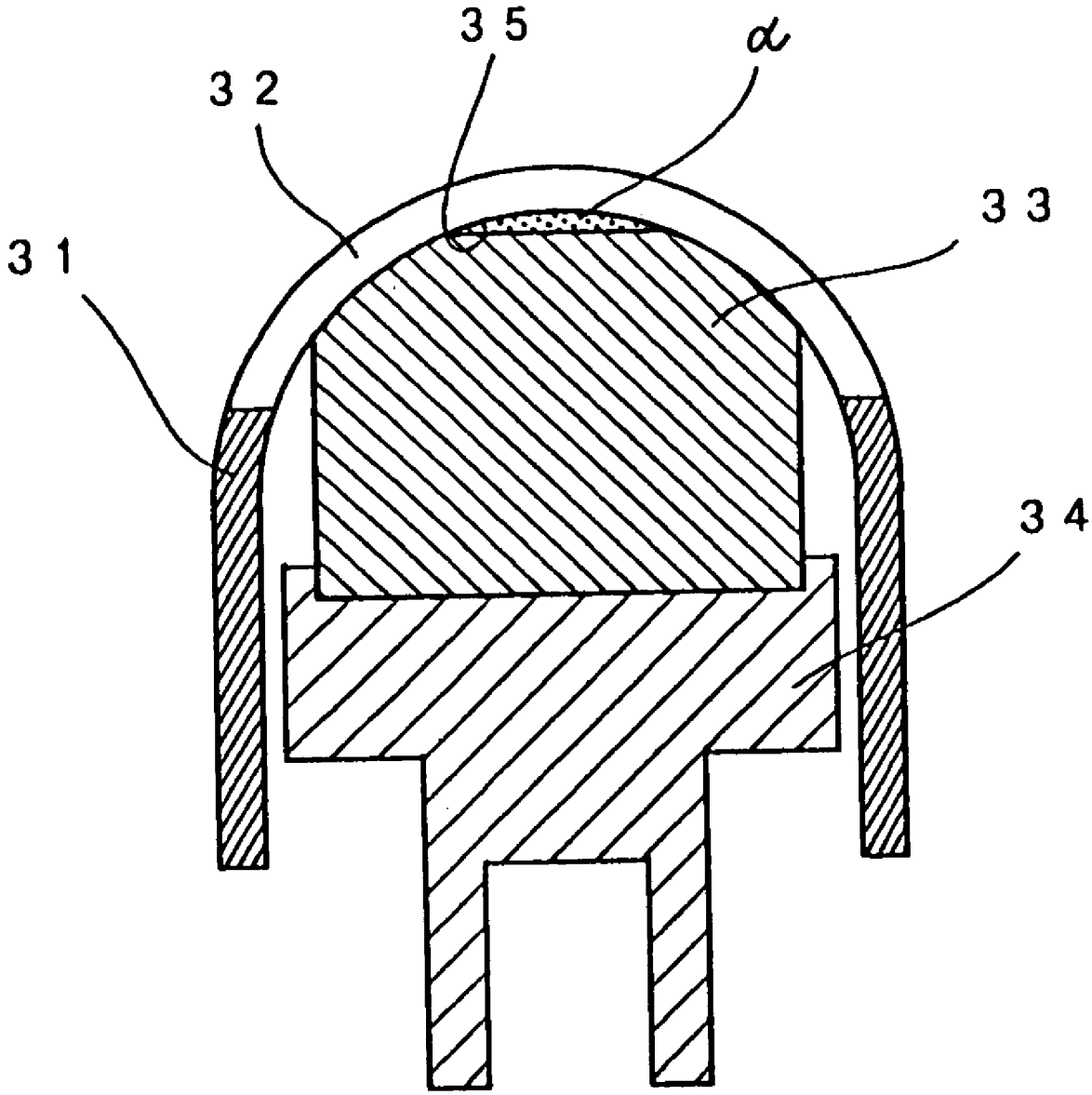
FIG. 24: A section view of more other examples of the present invention

In the example of the FIG. 24, the escaping concave 35 being flat upper in the center of the inner blade 33 is formed, wherein there is provided the introducing material α in the escaping concave 35.

Figure 25:
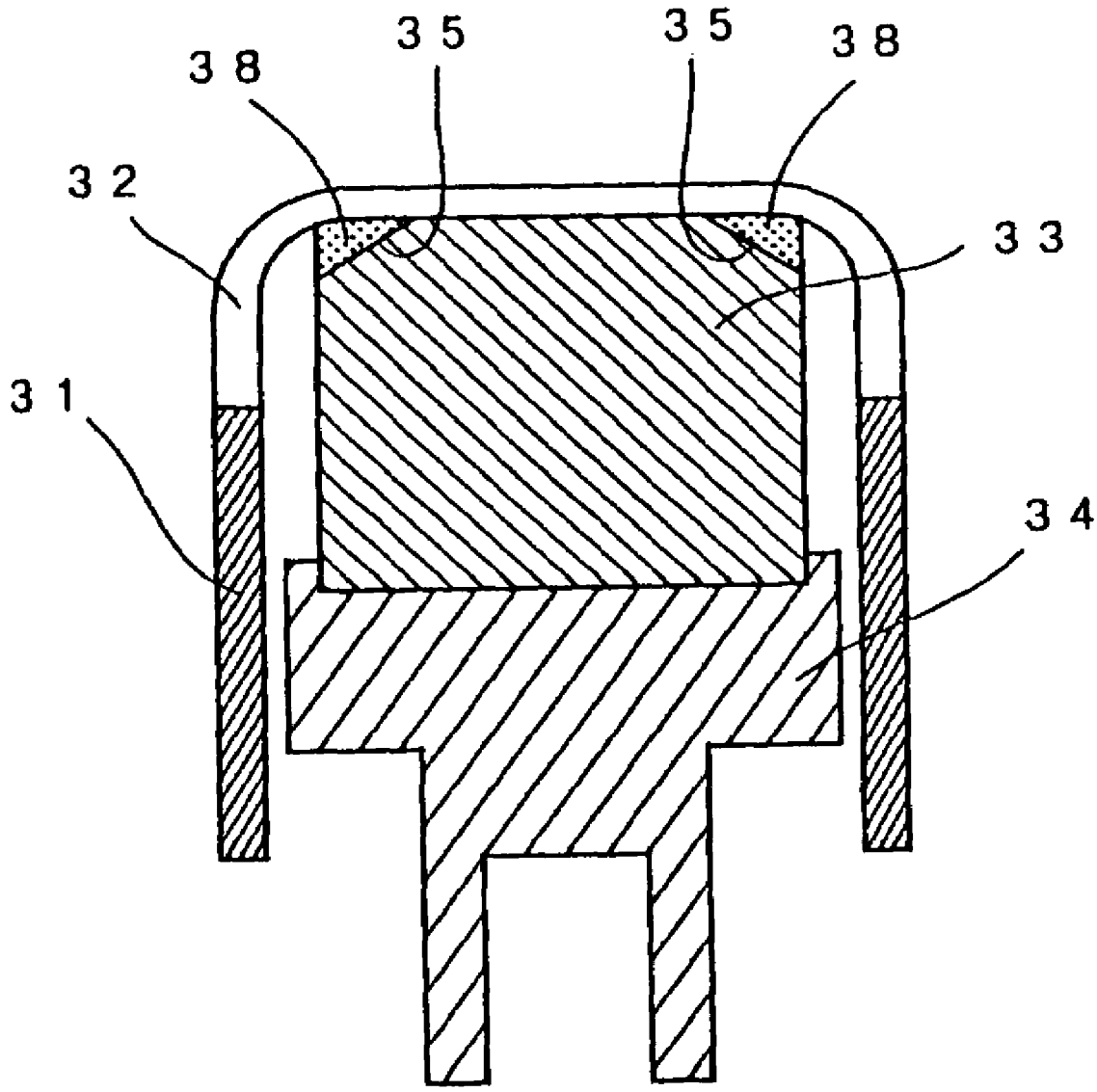
FIG. 25: A section view of more other examples of the present invention

In the example of the FIG. 25, the top part is flat and there are provided the outer blade 31 and the port 32 in the shape of a door, thus forming the inner blade 33 roughly in the shape of a rectangle corresponding to the outer blade 31, wherein there are provided escaping concave parts 35, 35 (escaping surface), which are slant, being inclined toward both sides, left and right, of the inner blade 33 and in both escaping concave parts 35, 35 there are provided the introducing materials α, α.

Figure 26:
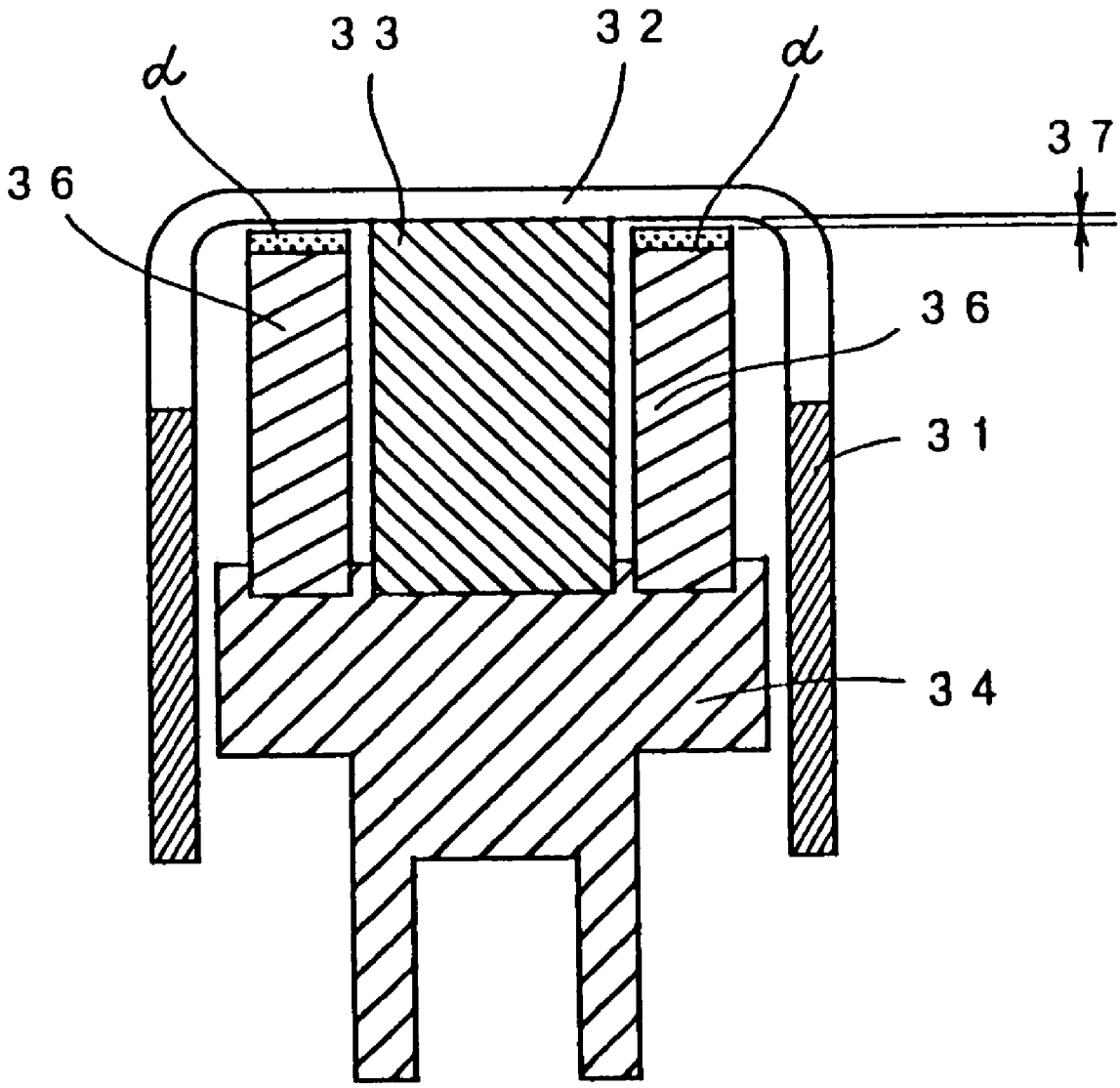
FIG. 26: A section view of more other examples of the present invention

In the example of the FIG. 26, the top part is flat and there are provided the outer blade 31 and the port 32 and the inner blade 33 is provided in the shape of a rectangle in the middle of the slider 34 and on both sides, left and right, of the slider 34 there are provided the assisting materials 36, 36 and the tip of these assisting materials 36 is installed inward to a given degree against the inner part of the outer blade 31 and on the tip of the assisting material 36 there is provided each of the introducing materials α, α, wherein the given clearance 37 is formed between the free end of the introducing materials α, α and the inner part of the outer blade 31, with the introducing material α being made of a structure for not being closed.

Figure 27:
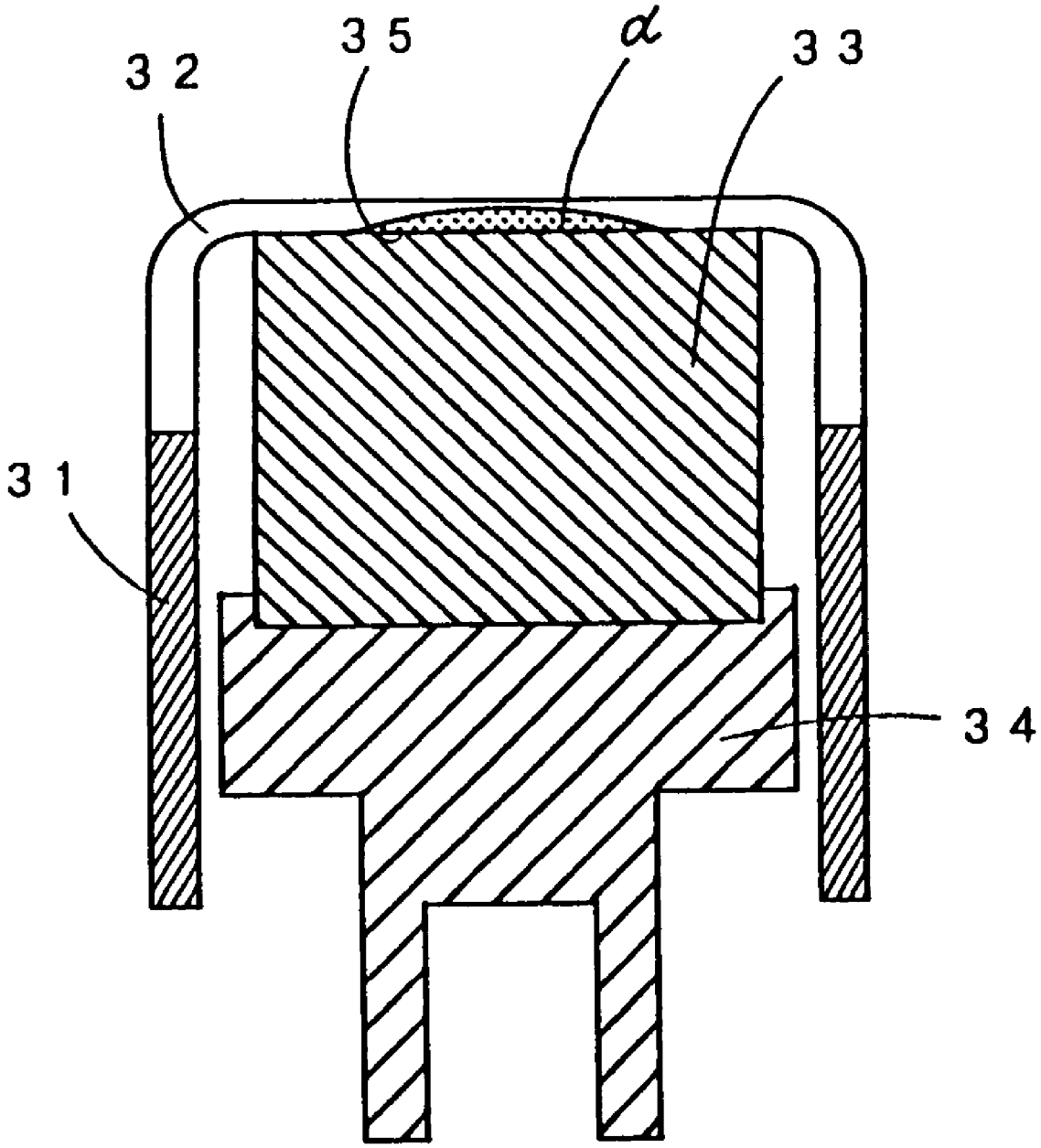
FIG. 27: A section view of more other examples of the present invention

In the example of the FIG. 27, the top part is flat and there are provided the outer blade 31 and the port 32 in the shape of a door and the inner blade 33 in the shape of a rectangle is installed on the whole region in the middle of the slider 34, wherein there is formed the escaping concave part 35 in the warped concave shape in the middle and inside of the outer blade 31, with the introducing material α in the escaping concave part 35 on the side of the outer blade 31.

Even though thus constructed, the same operations and effects can be obtained as the above-mentioned examples shown in the FIGS. 18~22 so that the same signs are put for the same parts in the FIGS. 24~27 as in the previous figures and more detailed explanations will be omitted, however, especially in the example of the FIG. 26, the introducing material α is formed with the clearance 37 on either side of the outer blade 31 or the assisting material 36 and with the introducing material α for not being closed, provided with the clearance 37, the hairs guided inside the outer blade 31 can be taken and cut without fleeing away from the port 32 while reducing the friction of motion in moving adjacently, wherein both blades 31, 33 move in relative movements or when the outer blade 31 and the assisting material 36 move in relative movements.

Additionally, in the FIGS. 24~27, the introducing material α is omitted and instead of the same, the escaping gap may be formed so that hairs can be taken out from the root of hair for a deep shaving.

Figure 28:
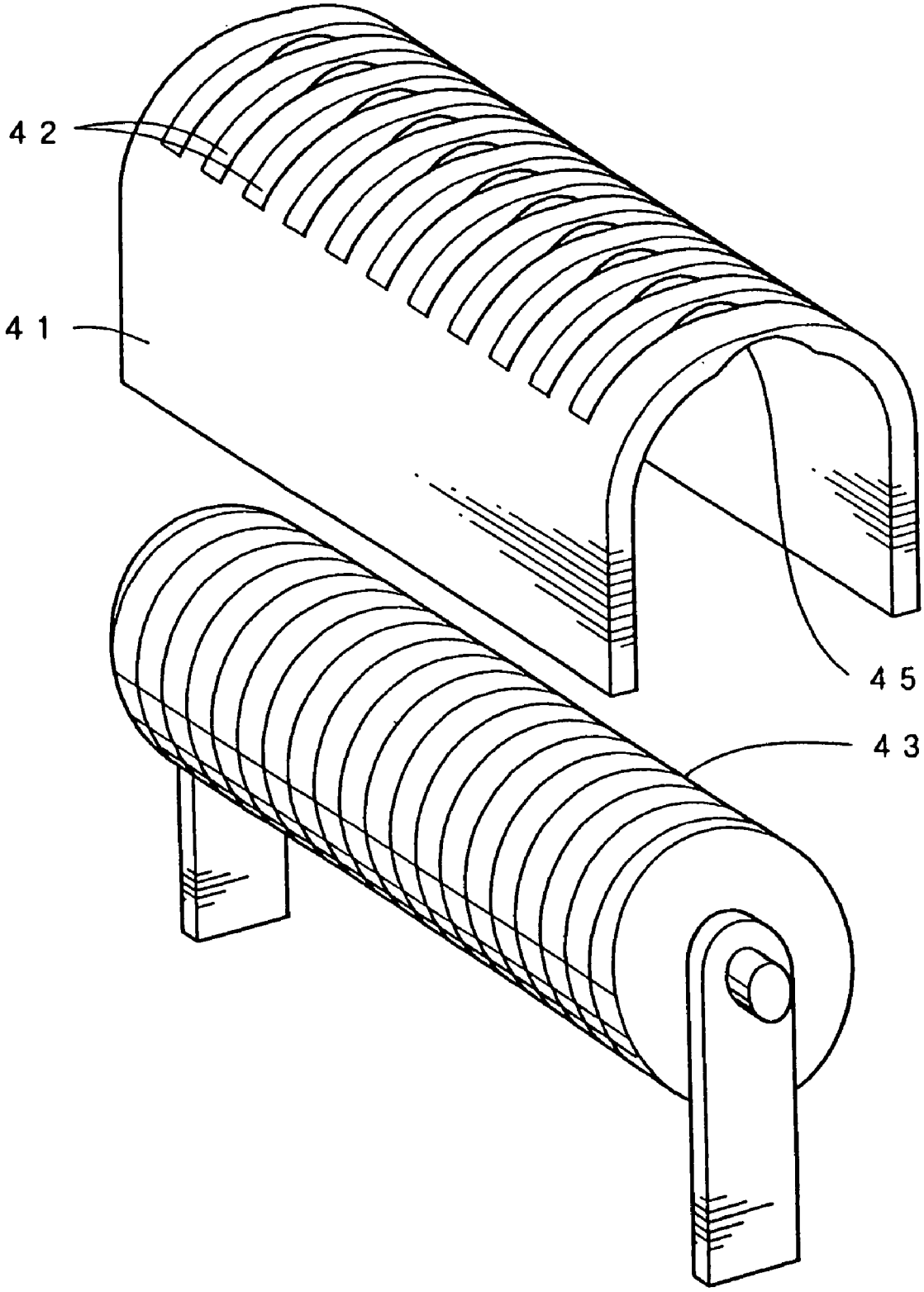
FIG. 28: A break-down perspective view of more other examples of the present invention
Figure 29:
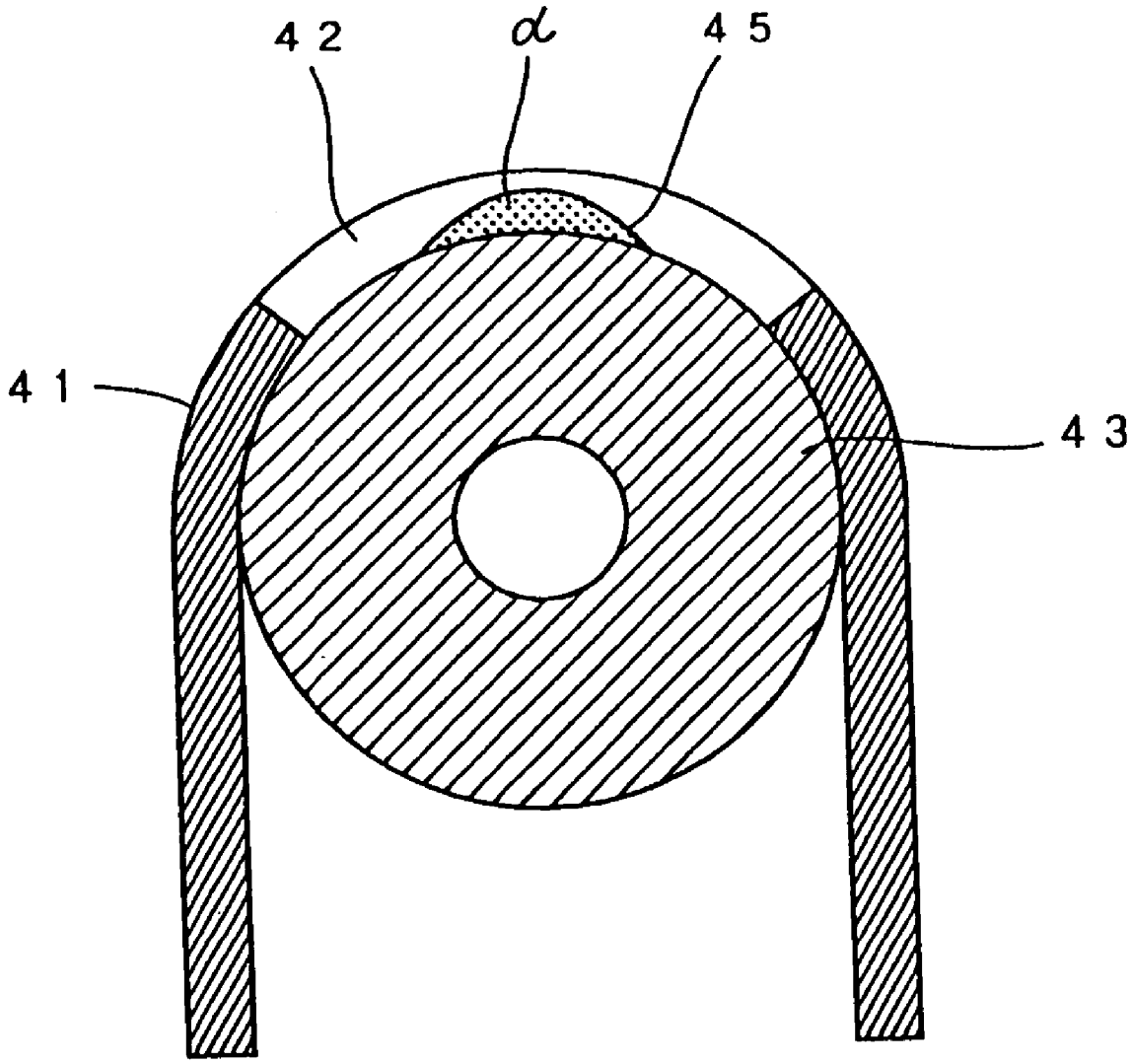
FIG. 29: A Section view of the outer and inner blades being composed
Figure 30:
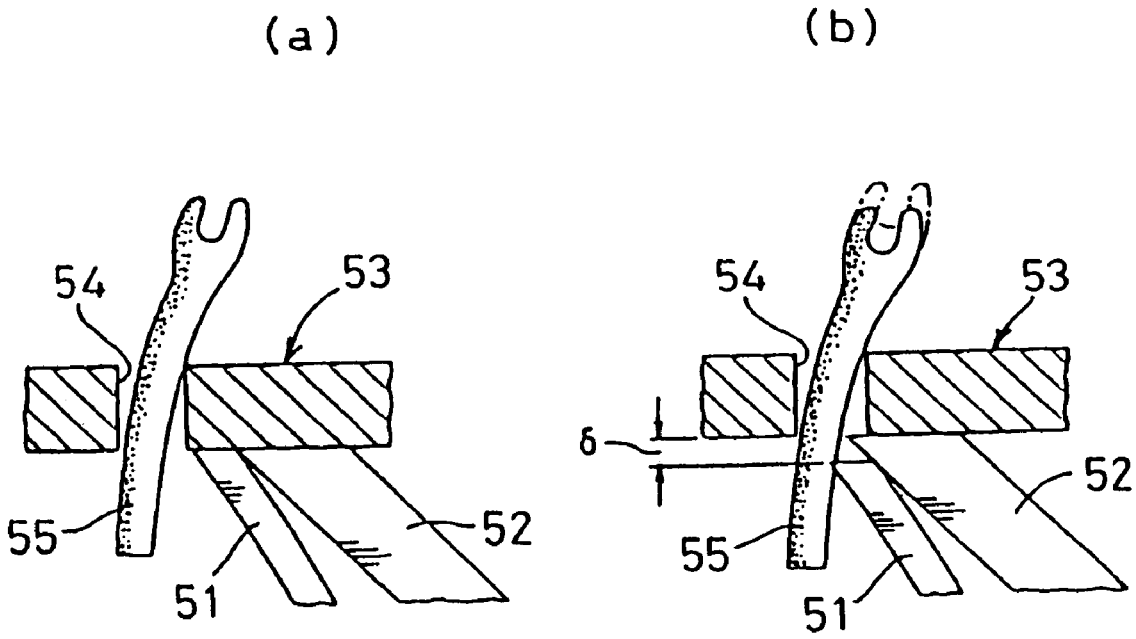
FIG. 30: A section view of the main part of the shaver as conventionally constructed.

The FIGS. 28 and 29 show more other examples of the shaver and in these figures, the shaver provided with the inner blade consisting in rotation (which rotates) is provided.

In other words, the shaver is provided with the outer blade 41 formed with a plurality of the ports 42, each one in parallel with another, which are in the shape of an arch, corresponding to the top shape (roughly of an arch) of the outer blade, together with the inner blade 43, which consists in rotation or rotating along the inner part of the outer blade 41. Furthermore, the inner blade 43 rotates along the virtual axle line extending horizontally along the outer blade 41.

In addition, the escaping concave part 45 is formed in the warped shape in the middle and inside of the outer blade 41 where the ports 42 are being formed and in the escaping concave part 45 of the outer blade 41, there is formed the introducing material α as shown in the FIG. 29.

Even when adapted for the shaver provided with the inner blade 43 consisting in rotation, the same effects can be obtained as with the shaver of different types and the introducing material α can prevent the hairs from fleeing away from the port 42, thus providing for an easy cutting and a deep shaving. It is noted that the introducing material α can be omitted from this example, wherein the same part may be formed as an escaping space so that the hairs 9 may be taken out for a deep shaving.

In addition, there are a lot of different designs concerning the shaver consisting in motion of moving back and forth adjacently and the rotary shaver and it is needless to say that the present invention can be adapted for each shaver of each design.

To summarize the above, according to the present invention, there is formed an escaping gap for taking out the hairs on at least one part between the outer blade and the inner blade, wherein the hairs guided into this gap will be hooked by the tip of the inner blade or pinched with the escaping gap, thus taking them out from the root of hair and when the hairs move to the region without any escaping gap, they can be cut in a deep position, providing for a deep shaving as a result.

The invention claimed is:

1. A shaver head comprising:

an outer blade with a plurality of hair guiding holes on an outer surface thereof for passage therethrough of hair to be cut; and a plurality of inner blades disposed adjacent to an inner surface of said outer blade and movable relative thereto; wherein at least one part between said outer blade and one of said plurality of inner blades forms a hair pinching gap for pulling hair passed through said holes by said outer blade and said one of said plurality of inner blades; and wherein said hair pinching gap is formed to narrow a width of said gap toward a part without any hair pinching gap; and wherein one of said plurality of inner blades cuts hair after said hair is pulled out gradually and intermittently by a plurality of the preceding inner blades through said hair pinching gap; and wherein at least one of said holes for guiding said hair straddling both of a hair pulling region of a track formed by a trail of a drive of said pinching gap and a hair cutting region of a track formed by a trail of a drive of said part without any hair pinching gap; so that close shaving is attained without irritation; and wherein when hair is pulled out through said hair pinching gap in said hair pulling region of said track and is moved to said hair cutting region of said track one of said plurality of inner blades cuts said hair in said hair cutting region of said track.

2. The shaver head of claim 1, further comprising an elastic material disposed between said out blade and said plurality of inner blades for guiding hair into said hair pinching gap.

3. The shaver head of claim 2, wherein said elastic material is of suitable dimensions to close space between said plurality of inner blades and said outer blade.

4. A shaver head comprising:

an outer blade with a plurality of hair guiding holes on an outer surface thereof for passage therethrough of hair to be cut; and a plurality of inner blades disposed adjacent to an inner surface of said outer blade and movable relative thereto; wherein at least one part between said outer blade and one of said plurality of inner blades forms a hair pinching gap for pulling hair passed through said holes by said outer blade and said one of said plurality of inner blades; and wherein one of said plurality of inner blades cuts hair after said hair is pulled out gradually and intermittently by a plurality of the preceding inner blades through said hair pinching gap; and wherein a hair pulling region defined by a pulling gap located between said outer blade and said plurality of inner blades, said hair pulling region being adjacent to a hair cutting region gap not involved in pulling hair and located between said outer blade and said plurality of inner blades without any overlapping; and wherein at least one of said holes for guiding hair straddles both of said hair pulling region and said hair cutting region; so that close shaving is attained without irritation; and wherein when said hair is pulled out through said hair pinching gap in said hair pulling region and is moved to said hair cutting region, one of said plurality of inner blades cuts said hair in said hair cutting region.

5. The shaver head of claim 4, wherein said hair pinching gap is formed to narrow a width of said gap toward said part without any hair pinching gap.

6. The shaver head of claim 5, further comprising an elastic material disposed between said outer blade and said plurality of inner blades for guiding hair into said hair pinching gap.

7. The shaver head of claim 6, wherein said elastic material is of suitable dimensions to close space between said plurality of inner blades and said outer blade.

* * * * *